US009061343B2

(12) United States Patent
Watkins et al.

(10) Patent No.: US 9,061,343 B2
(45) Date of Patent: Jun. 23, 2015

(54) INDEXING MACHINE WITH A PLURALITY OF WORKSTATIONS

(75) Inventors: Evan D. Watkins, Evergreen, CO (US); Michael Atkinson, Lafayette, CO (US)

(73) Assignee: Aleco Container, LLC, Arvada, CO (US)

( * ) Notice: Subject to any disclaimer, the term of this patent is extended or adjusted under 35 U.S.C. 154(b) by 845 days.

(21) Appl. No.: 13/215,055

(22) Filed: Aug. 22, 2011

(65) Prior Publication Data

US 2012/0042708 A1 Feb. 23, 2012

Related U.S. Application Data

(60) Provisional application No. 61/376,214, filed on Aug. 23, 2010.

(51) Int. Cl.

| | |
|---|---|
| ***B21D 51/26*** | (2006.01) |
| ***B21D 43/05*** | (2006.01) |
| ***B21K 21/12*** | (2006.01) |

(52) U.S. Cl.

CPC ..... *B21D 51/2692* (2013.01); *B21D 43/05* (2013.01); *B21D 51/2638* (2013.01); *B21K 21/12* (2013.01)

(58) Field of Classification Search

CPC .... B21D 43/02; B21D 51/26; B21D 51/2638; B21D 43/04; B21D 43/05; B21D 43/055; B21D 51/2692; B21K 21/12

USPC ..... 72/347, 348, 379.4, 405.01, 405.03, 72/405.07; 413/69, 73, 76

See application file for complete search history.

(56) References Cited

U.S. PATENT DOCUMENTS

| | | | | |
|---|---|---|---|---|
| 3,983,729 | A | | 10/1976 | Traczyk et al. |
| 4,096,731 | A | * | 6/1978 | Uehlinger et al. ..... 72/405.07 |
| 4,166,372 | A | * | 9/1979 | Knight ..... 72/348 |
| 4,341,103 | A | | 7/1982 | Escallon et al. |
| 4,404,837 | A | * | 9/1983 | Allen et al. ..... 72/349 |
| 4,446,714 | A | * | 5/1984 | Cvacho ..... 72/370.02 |
| 4,774,839 | A | | 10/1988 | Caleffi et al. |
| 5,349,837 | A | | 9/1994 | Halasz et al. |
| 5,353,619 | A | | 10/1994 | Chu et al. |
| 5,355,710 | A | | 10/1994 | Diekhoff |
| 5,768,931 | A | | 6/1998 | Gombas |
| 6,164,109 | A | | 12/2000 | Bartosch |
| 6,257,544 | B1 | | 7/2001 | Schultz |
| 6,752,000 | B2 | | 6/2004 | Reynolds et al. |
| 7,073,365 | B2 | | 7/2006 | Geho et al. |
| 7,503,741 | B2 | | 3/2009 | Gillest |
| 7,726,165 | B2 | | 6/2010 | Myers et al. |
| 2007/0266755 | A1 | | 11/2007 | Cook et al. |
| 2008/0148801 | A1 | | 6/2008 | Olson et al. |

OTHER PUBLICATIONS

International Search Report and Written Opinion mailed Mar. 27, 2012, in counterpart international application No. PCT/US2011/048681 (9 pages).

* cited by examiner

*Primary Examiner* — Debra Sullivan

(74) *Attorney, Agent, or Firm* — William P. O'Meara, Esq; Klaas, Law, O'Meara & Malkin P.C.

(57) ABSTRACT

A machine may include a plurality of stations, e.g., for performing progressive die-necking of open-ended container bodies. A conveyer may be provided to index the open-ended container bodies in a linear manner through the machine from station to station.

19 Claims, 19 Drawing Sheets

INDEXING MACHINE WITH A PLURALITY OF WORKSTATIONS

CROSS-REFERENCE TO RELATED APPLICATIONS

This application claims the benefit of U.S. provisional application Ser. No. 61/376,214, filed Aug. 23, 2010, for INDEXING MACHINE WITH A PLURALITY OF WORKSTATIONS of Evan D. Watkins and Michael Atkinson, the entirety of which is hereby incorporated by reference herein.

BACKGROUND

It is often desirable to reshape the opening of a container body that is open on one end (i.e., an "open ended container body") during the process of manufacturing a container. One example of such reshaping is a process known as "necking" in which the diameter of the container body opening is reduced in order, for example, to allow the use of a smaller diameter lid or end for the container. In another example of reshaping, a "flanging" process may be employed to form a flange on the container open end. Flanges are often used to facilitate attachment of a lid to a container body. Other exemplary reshaping operations may involve expansion or the formation of features such as threads on a portion of the container body.

In a die necking operation, the open end of a typically cylindrical, thin walled metal container body is forcefully brought into contact with a die having a smaller diameter than the open end of the container body. Contact between the container body open end and the die, in this manner, results in a reduction in diameter of the open end. In a progressive die necking operation, the container body open end is forced into a series of progressively smaller dies in order to achieve a progressive reduction in diameter of the open end. In a typical die necking operation, a knockout element (sometimes also referred to as a "knockout punch" or a "knockout die") may be used to provide support, during the necking operation, to the inside diameter of the open end of the container body. Methods and apparatus for die necking containers are disclosed, for example, in U.S. Pat. No. 5,355,710 of Diekhoff and U.S. Pat. No. 5,768,931 of Gombas, both of which are hereby incorporated by reference herein for all that is disclosed therein.

DETAILED DESCRIPTION

Figure 1:
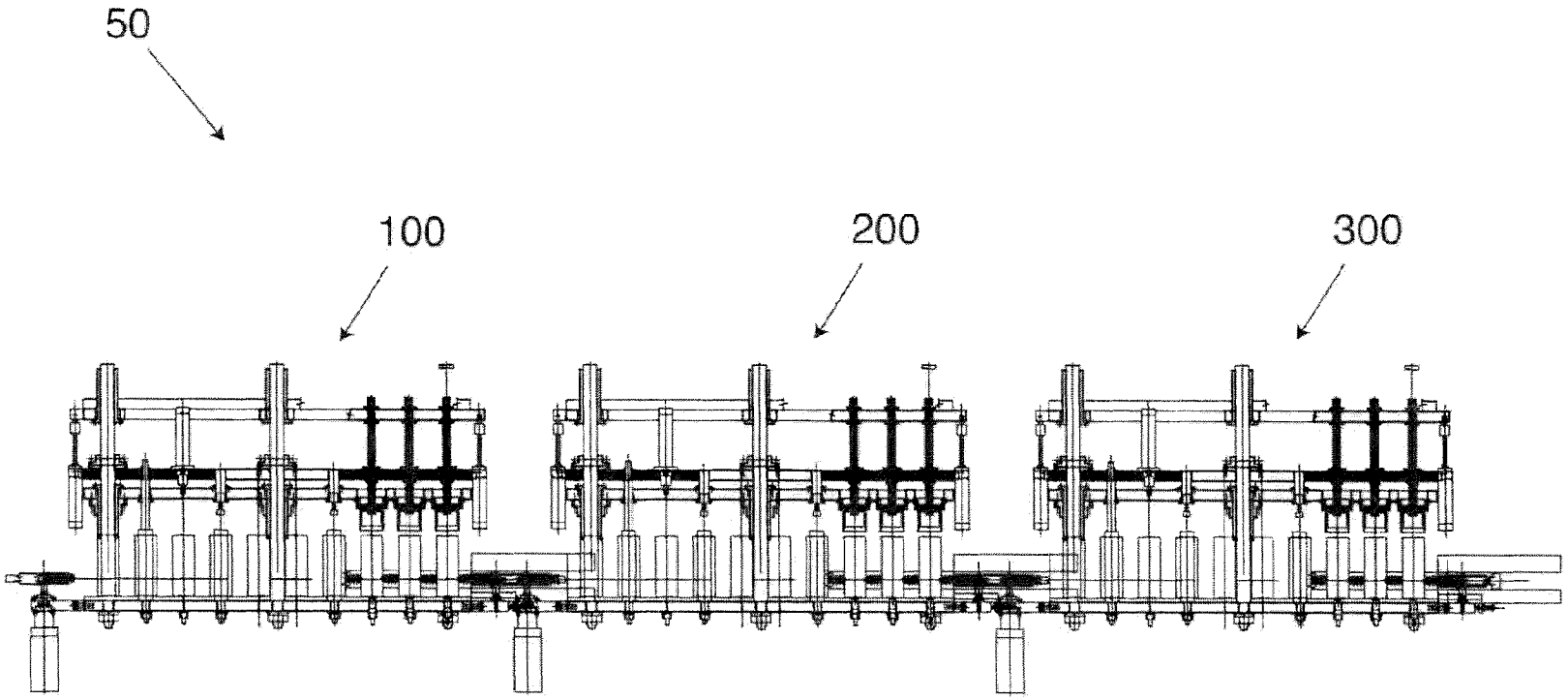
FIG. 1 is a front elevation view of one exemplary embodiment of a manufacturing system.
Figure 2:
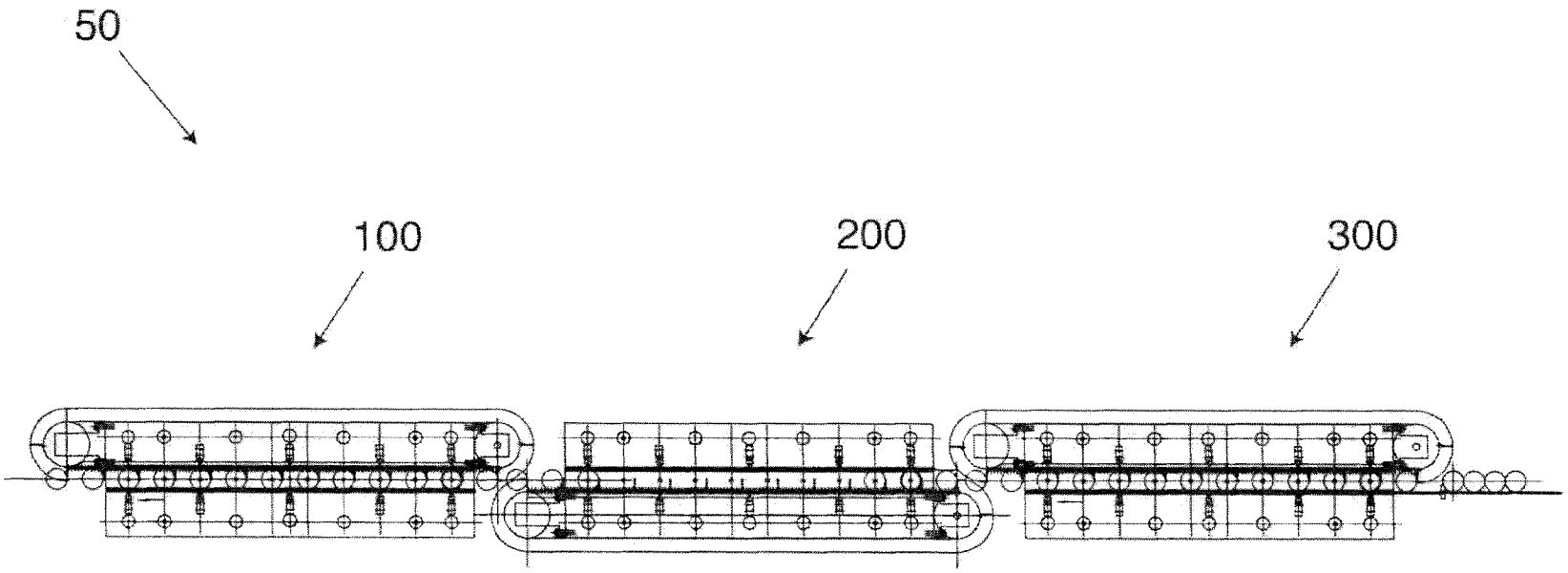
FIG. 2 is a top plan view of the exemplary manufacturing system shown in FIG. 1.

FIGS. 1 and 2 show an exemplary embodiment of a manufacturing system 50 which may be used, for example, to progressively die-neck open ended containers in a series of die-necking stations. As mentioned previously, the basic concept of die necking is to take a typically cylindrical, thin walled metal container body or shell having a given diameter and forcefully bring the open end into contact with a series of progressively smaller dies. In the course of this process, a progressive reduction in diameter of the open end is realized.

Figure 7:
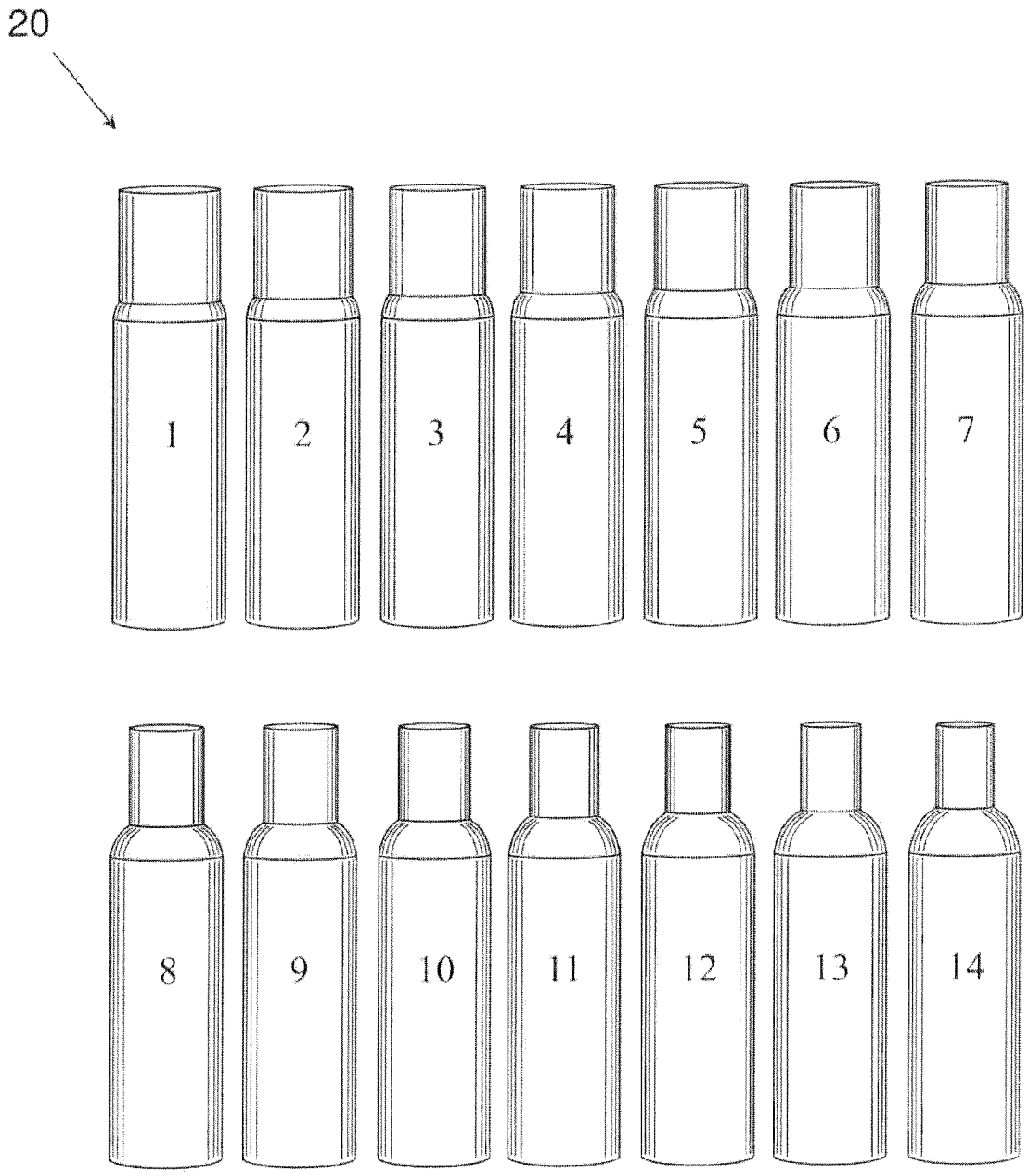
FIG. 7 is a schematic illustration depicting an exemplary series of container bodies after each stage of die-necking by a die-necking system.

FIG. 7 depicts an exemplary series of container bodies 20 shown after each stage of die-necking by a die-necking system. More specifically, FIG. 7 depicts the progression of die-necking from an initial necking die to produce the first die-necked container body 1 to a final necking die to produce the final die-necked container body 14. It is to be understood that FIG. 7 depicts a necking system having 14 stages for exemplary purposes only. The actual number of die-necking stages may vary depending on the material used to form the container body, the container body's sidewall thickness, the initial diameter of the container body, the final diameter of the container body and the required shape of the neck profile.

Figure 8:
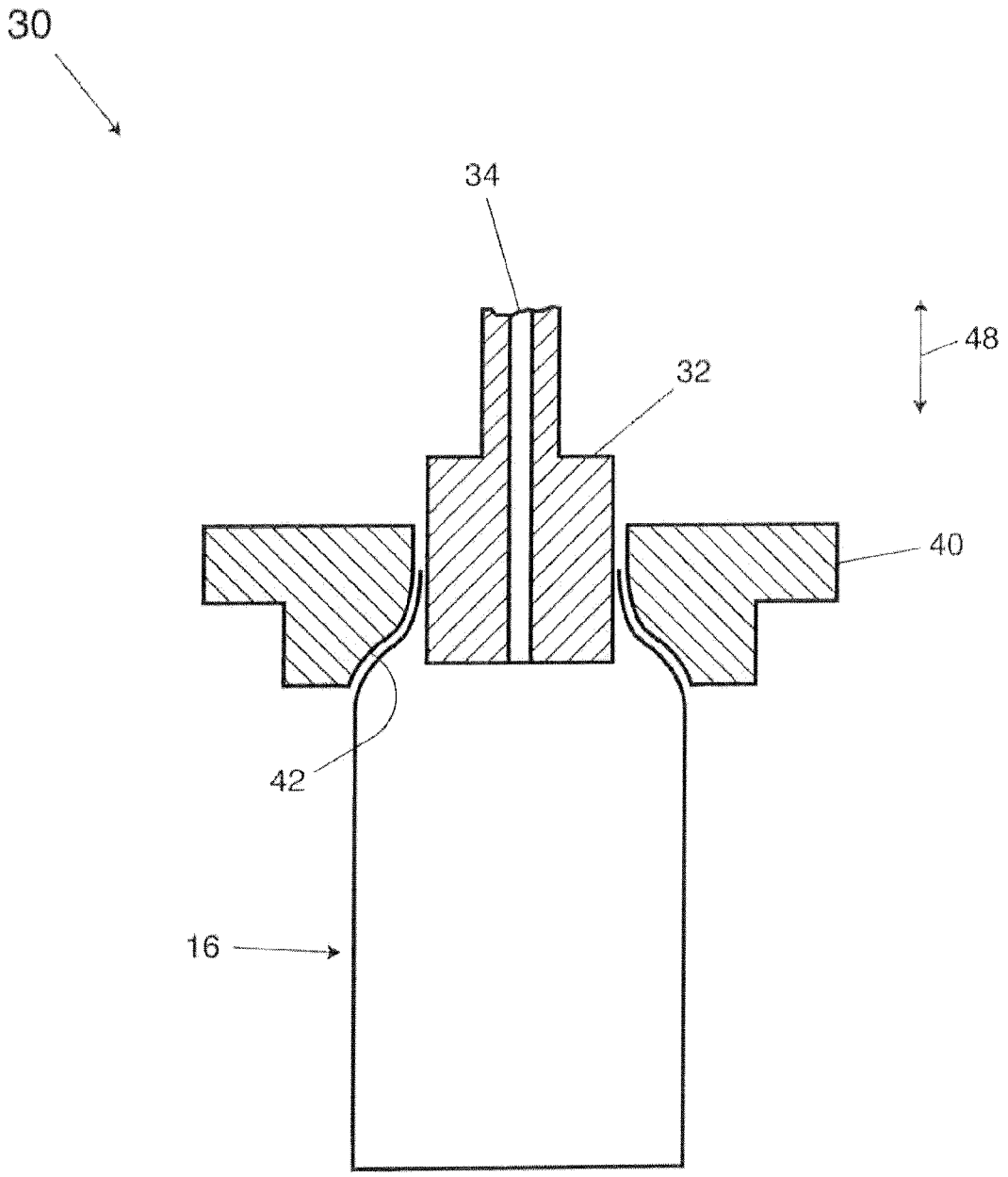
FIG. 8 is a schematic cross-sectional elevation view of an exemplary die set usable to die-neck container bodies.

FIG. 8 illustrates, schematically, an exemplary mechanism 30 to accomplish a single stage of a die-necking operation, as discussed above, on a container body 16. With reference to FIG. 8, the mechanism 30 may generally include a knockout element 32 (sometimes also referred to as a knockout punch or a knockout die) and a necking die 40 (sometimes also referred to as a forming die). The knockout element 32 and the necking die 40 are each capable of individual movement, relative to the container body 16, in the directions indicated by the arrow 48.

In operation, the knockout element 32 is first extended toward the container body 16 such that it is inserted inside the open end of the container body 16, generally to a point beyond where a reduction in the diameter of the sidewall of the container body 16 will occur, as shown in FIG. 8. Once the knockout element 32 is in place, the necking die is moved toward the open end of the container body 16 such that an inner forming surface 42 of the necking die 40 comes into contact with the outer surface of the container body 16. Air under pressure may then be introduced into the interior of the container body 16 through a channel 34 passing through the knockout element 32, serving to pressurize the container body 16 to maintain its structural integrity in the axial directions during the die-necking operation. Concurrently, sufficient linear force is applied to the necking die 40 to cause the open end of the container body 16 to conform to the shape of the inner forming surface 42 of the necking die 40, and thus, reduce the diameter of the open end.

The knockout element 32 provides support, during this process, to the inside diameter of the open end of the container body 16. In some systems, the knockout element 32 may be in motion (e.g., retracting from the open end of the container body 16) while the die-necking operation is taking place in order to assist in drawing the metal in a longitudinal direction and to prevent pleating of the metal container 16 in the neck portion.

After the necking die 40 has reached its maximum extension relative to the container body 16, the die-necking stage is completed. Thereafter, the necking die is moved away from the container body open end and the knockout element 32 withdrawn from the container body. Both the knockout element 32 and the air pressure inside the container body 16 help to separate the container body 16 from the necking die 40.

As can be appreciated, the above process takes place in each stage of the overall die-necking operation. In each stage, however, the size of the necking die and knockout element is smaller than in the preceding stage such that, as a container body advances through the stages, a progressive reduction in diameter of the open end is realized, as generally depicted in FIG. 7.

Figure 3:
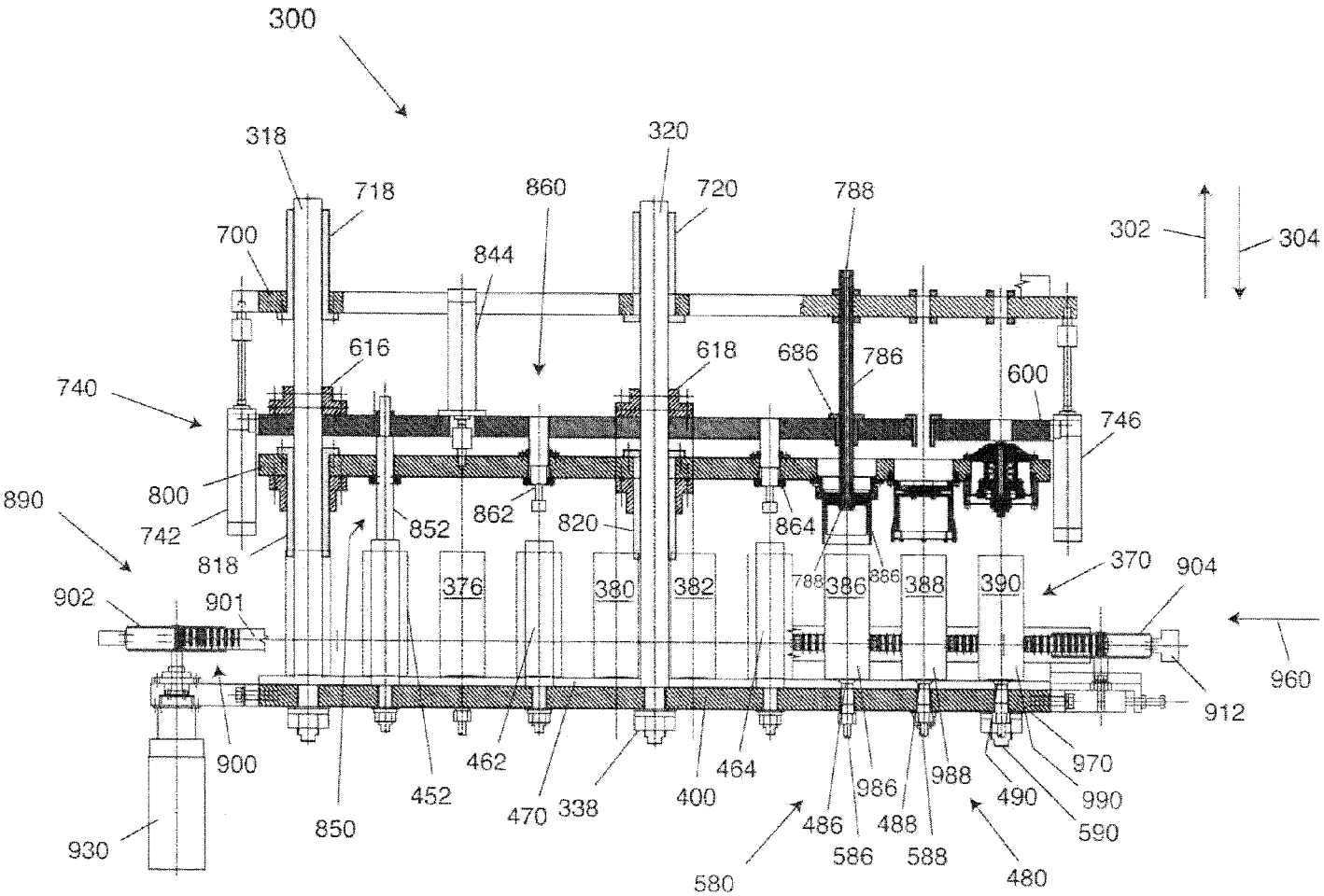
FIG. 3 is front elevation view, in part cross-section, of an exemplary modular unit of the manufacturing system of FIG. 1.
Figure 4:
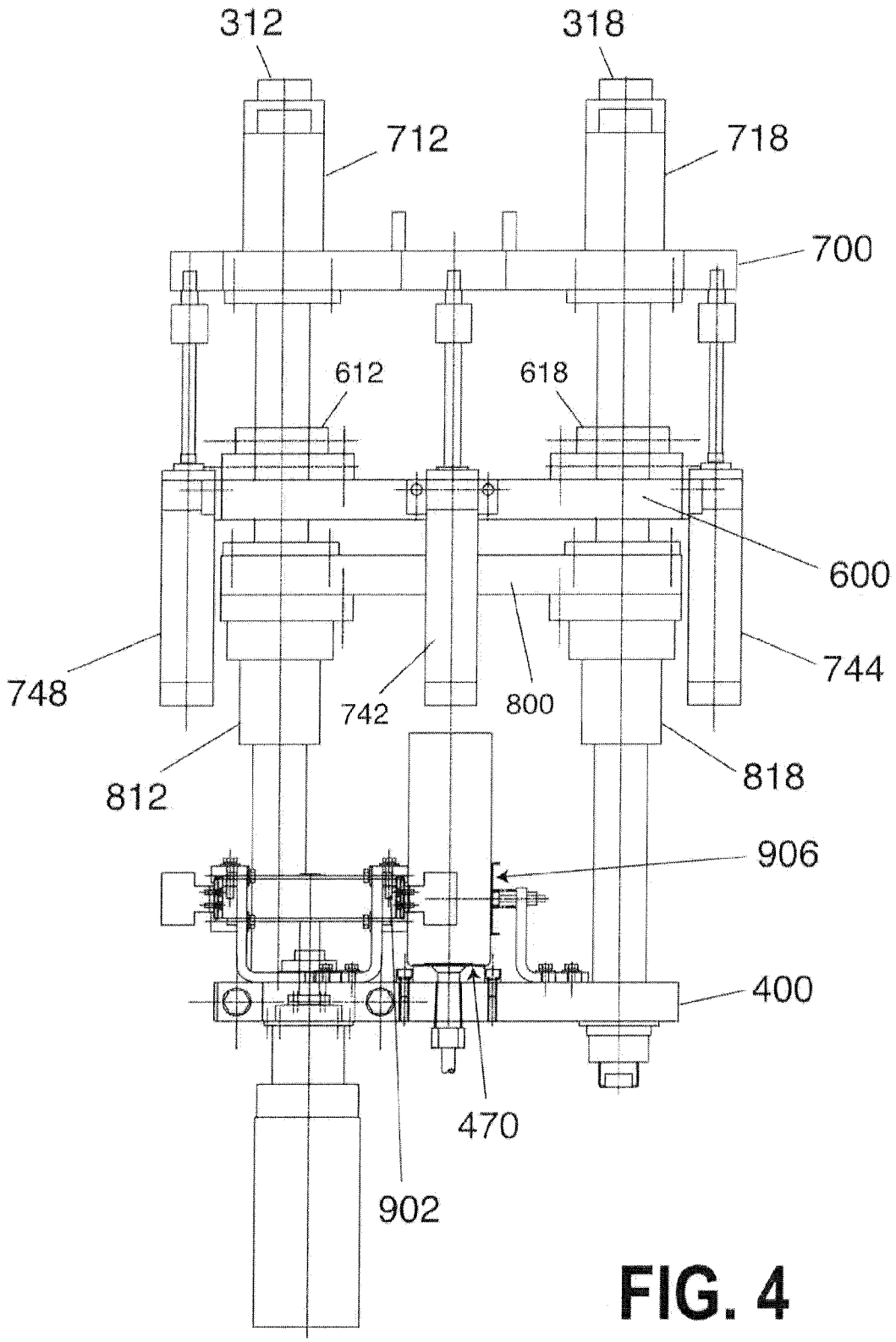
FIG. 4 is left side elevation view of the exemplary modular unit of FIG. 3.
Figure 5:
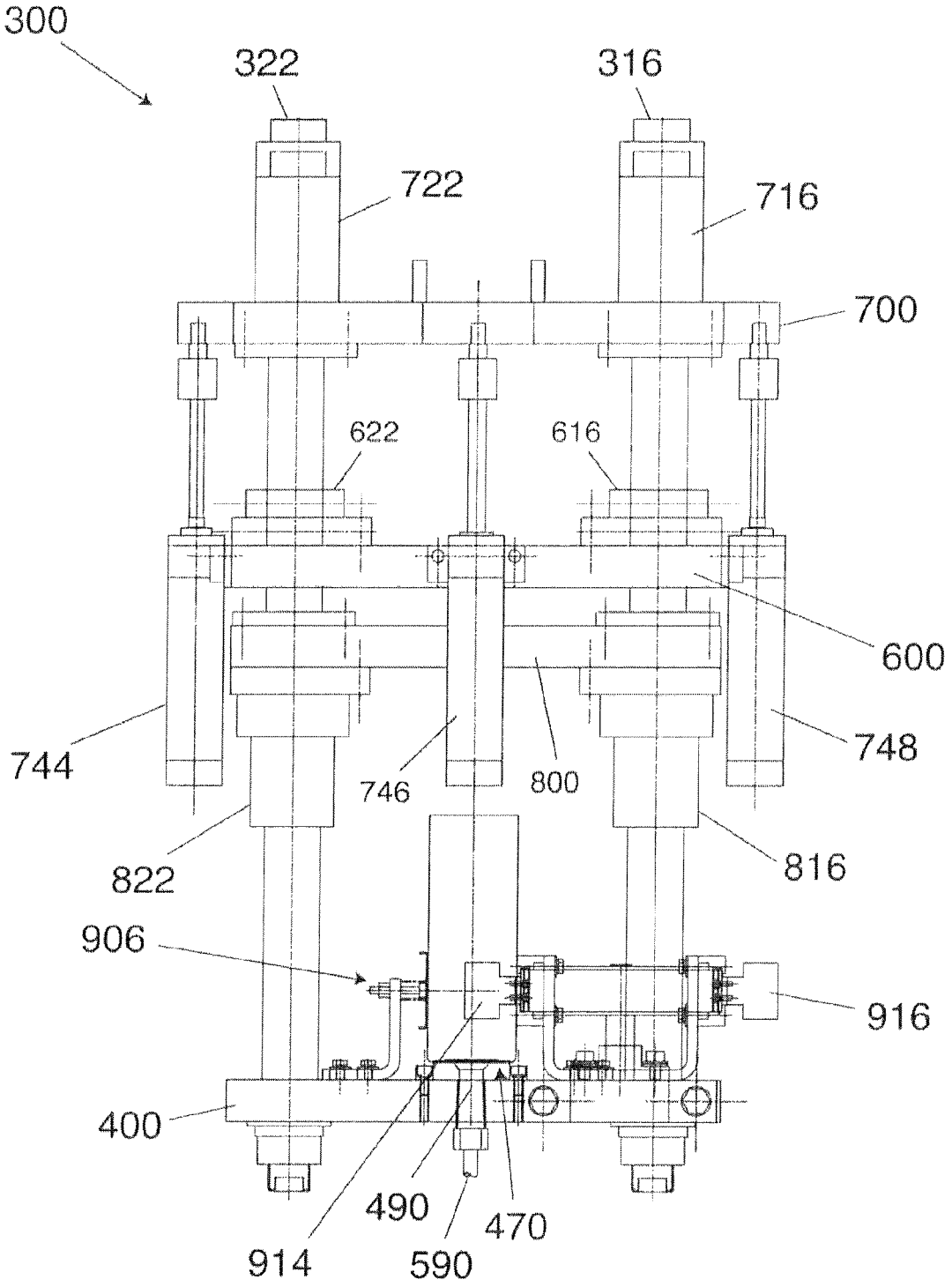
FIG. 5 is a right side elevation view of the exemplary modular unit of FIG. 3.

Referring again to FIGS. 1 and 2, the manufacturing system 50 may include a plurality of modular units, such as the modular units 100, 200, 300. FIGS. 3-6 illustrate the modular unit 300 in further detail. With reference to FIGS. 3-5, the modular unit 300 may include a stationary base plate 400 and a stationary support plate 600 arranged in a substantially parallel manner with respect to the stationary base plate 400. The stationary base plate 400 may, for example, be rigidly secured by machine framework, not shown, to the floor of a manufacturing facility.

Figure 6:
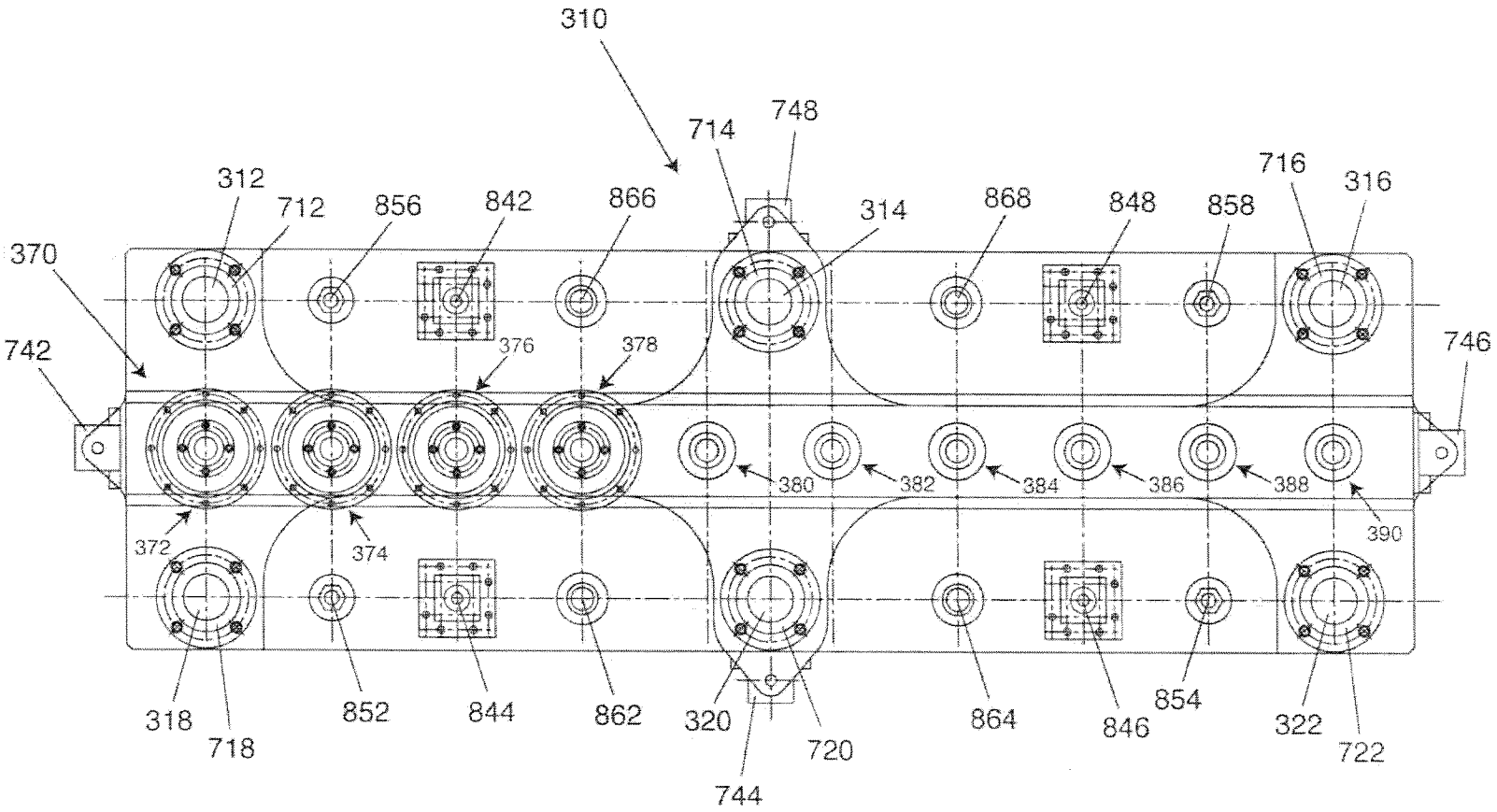
FIG. 6 is a top plan view of the exemplary modular unit of FIG. 3.

With reference, for example, to FIG. 6, a plurality of guide posts 310, including the individual guide posts 312, 314, 316, 318, 320 and 322, may be secured at their lower ends to the base plate 400 using, for example, threaded fasteners such as the threaded nut 338 shown in conjunction with the guide post 318, FIG. 3.

Stationary support plate 600 may be rigidly attached to the guide posts 310 via a plurality of attachment blocks 610 fitted to each of the guide posts 310 (for example, the attachment blocks 612, 616, 618, 620 and 622 shown in conjunction with the guide posts 312, 316, 318, 320 and 322, respectively). In this manner, the support plate is fixed in a stationary and substantially parallel relationship with respect to the base plate 400.

With reference, for example, to FIGS. 3-5, the modular unit 300 may further include a movable upper drive plate 700 located above the stationary support plate 600, as shown. Upper drive plate 700 may be slidingly mounted on the guide posts 310 via a plurality of bearings 710. Specifically, the bearings 710 may include, for example, the individual bearings 712, 714, 716, 718, 720 and 722 mounted on the guide posts 312, 314, 316, 318, 320 and 322, respectively. The bearings 710 may, for example, be linear ball bearing assemblies. A plurality of hydraulic actuators 740, including the individual actuators 742, 744, 746, 748, may be attached between the upper drive plate 700 and the stationary support plate 600, as shown. The actuators 740 may be connected to a first control valve of a hydraulic pump system, not shown, in a conventional manner such that selective actuation of the first control valve will cause the upper drive plate 700 to move in the directions 302 or 304, FIG. 3.

With reference again to FIGS. 3-5, the modular unit 300 may further include a movable lower drive plate 800 located below the stationary support plate 600 and above the stationary base plate 400. Lower drive plate 800 may be slidingly mounted on the guide posts 310 via a plurality of bearings 810. Specifically, the bearings 810 may include, for example, the individual bearings 812, 816, 818, 820 and 822 mounted on the guide posts 312, 316, 318, 320 and 322, respectively. The bearings 810 may, for example, be linear ball bearing assemblies. A plurality of hydraulic actuators 840, including the individual actuators 842, 844, 846, 848, may be attached between the lower drive plate 800 and the stationary support plate 600, as shown. The actuators 840 may be connected to a second control valve of the hydraulic pump system, not shown, in a conventional manner such that selective actuation of the second control valve will cause the lower drive plate 800 to move in the directions 302 or 304, FIG. 3.

Lower drive plate 800 may further include a plurality of hard stop pins 850, FIG. 3, including the individual hard stop pins 852, 854, 856, 858, as shown in FIGS. 3 and 6. Each of the hard stop pins 850 may be configured to contact a corresponding pin post attached to the stationary base plate 400. With reference to FIG. 3, for example, it can be seen that the hard stop pin 852 is configured to contact the base plate pin post 452. The hard stop pins 850 serve to provide a definite limit of downward travel for the lower drive plate 800 and may be configured to allow easy adjustment of this limit.

Lower drive plate 800 may further include a plurality of resilient damping mechanisms 860, including the individual damping mechanisms 862, 864, 866, 868, as shown in FIGS. 3 and 6. Each of the damping mechanisms may include a resiliently-mounted (e.g., spring-loaded) plunger adapted to contact a corresponding pin post attached to the stationary base plate 400. The damping mechanisms 862, 864, for example, may each include a resiliently mounted plunger adapted to contact the base plate pin posts 462, 464, respectively, as shown in FIG. 3. The damping mechanisms 860 serve to slow the movement of the lower drive plate 800 when it is moving in the direction 304 and, thus, cushion the impact of the lower drive plate hard stop pins 850 with their corresponding pin posts on the base plate 400, as described above.

It is noted that the upper drive plate 700 and the lower drive plate 800 have been described above as being movable by hydraulic actuators. It is to be understood, however, that this description is provided for exemplary purposes only and that other types of actuators (e.g., pneumatic cylinders, linear motors, screw-drive arrangements) could readily be used in place of the hydraulic actuators described.

With reference again to FIGS. 3-6, the modular unit 300 may include, for example, a plurality of workstations 370, such as the individual work stations 372, 374, 376, 378, 380, 382, 384, 386, 388, 390. The workstations may be used, for example, to die-neck open ended container bodies, with each workstation containing a progressively smaller necking die, in a manner such as previously described.

With reference, for example, to FIGS. 3-5, a guide plate 470 may be positioned above the stationary base plate 400 for the purpose of supporting container bodies as they advance through the modular unit 300, in a manner described in further detail below. The guide plate 470 may include a plurality of holes 480, one located within each of the workstations 370. With reference to FIGS. 3 and 5, the holes 480 in the guide plate 470 include, for example, the individual holes 486, 488 and 490 located within the workstations 386, 388 and 390, respectively. Each of the holes 480 may be generally circular in cross section and may have a larger diameter flared or countersunk portion near the upper surface of the guide plate 470, as shown. The holes 480 may align with similar holes that extend through the stationary base plate 400 and which terminate in vacuum fittings 580, such as the individual vacuum fittings 586, 588, 590, shown with respect to the workstations 386, 388 and 390, respectively. The vacuum fittings 580 may be connected to a vacuum source in order to supply vacuum to the upper surface of the guide plate 470 at the locations of the holes 480 within each of the workstations 370. As will be described in further detail herein, the vacuum supplied by the holes 480 serves to hold the container bodies securely against the guide plate 470 while they are being die-necked within each of the workstations 370.

The lower drive plate 800 may include a plurality of necking dies fixedly attached thereto, one necking die located within each of the workstations 370. With reference to FIG. 3 it can be seen, for example, that the lower drive plate 800 includes a necking die 886 within the workstation 386. As can be appreciated, movement of the lower drive plate 800 will result in corresponding movement of the attached necking dies.

The upper drive plate 700 may include a plurality of shafts fixedly attached thereto, one shaft located within each of the workstations 370. Each of these shafts passes through a bearing in the stationary support plate 600 and has a knockout element attached at the lower end thereof. With reference to FIG. 3, it can be seen, for example, that the shaft 786 is attached to the upper drive plate 700 in the area of the workstation 386. The shaft 786 passes through a bearing 686 in the stationary support plate 600. A knockout element 788 is attached at the lower end of the shaft 786. As can be appreciated, movement of the upper drive plate 700 will result in corresponding movement of the attached knockout elements. Further, each of the upper drive plate shafts may also include a channel extending therethrough (see, e.g., the channel 790 extending through the shaft 786, FIG. 3) for the purpose of supplying pressurized air to a container body being die-necked.

With reference to FIGS. 3-5, the modular unit 300 may generally include a transport system 890 for moving open ended container bodies (in the direction 960, FIG. 3) in a stepwise, or indexing, fashion such that the open ended container bodies advance from workstation to workstation within the modular unit 300 and dwell within each workstation while the die-necking operation is carried out. The transport system 890 may take the form of any conventional type of movement device, for example, a screw conveyor, a belt-type conveyor or a pick and place mechanism.

In a preferred embodiment, the transport system 890 may, for example, be provided as a belt-type conveyor 900. With reference again to FIGS. 3-5, the belt-type conveyor 900 may include an endless belt 901 supported between a pair of pulleys 902, 904 that are each rotatably secured to the stationary base plate 400. The belt 901 may include a plurality of paddles, such as the paddles 912, 914, 916 illustrated in FIGS. 3 and 5, and may be driven by a drive motor 930, FIG. 3. With reference to FIG. 3, in operation, the belt 901 advances open ended container bodies (e.g., the container bodies 986, 988, 990) through the modular unit 300, in the direction 960, by contacting the container bodies with the paddles. As can be appreciated with reference to FIGS. 4 and 5, transverse alignment of the container bodies, while being conveyed through the modular unit, is achieved by contacting the container bodies, on one side, with the belt 901 and, on the opposite side, by a guide rail assembly 906 that is secured to the stationary base plate 400. The drive motor 930 advances the conveyor belt 900 in a stepwise, or indexing, fashion such that the open ended container bodies advance from station to station within the modular unit 300 and dwell within each station while the die-necking operation is carried out.

The die-necking operation takes place in each station of the modular unit in a manner similar to that previously described with respect to FIG. 8. With respect to the station 386 in FIG. 3, for example, the conveyor 900 first indexes the container body 986 into place within the workstation 386, as shown. Vacuum supplied to the vacuum holes 480, including, for example, the vacuum hole 486 located within the workstation 386, ensures that the bottom of the container 986 is securely held against the upper surface of the guide plate 470. The upper drive plate 700 is then caused to move in the direction 304 by the hydraulic actuators 740. This, in turn, causes the knockout element 788 to extend into the container body 986 so that it becomes inserted inside the open end of the container body 986. Once the knockout element 788 is in place, the lower drive plate 800 is caused to move in the direction 304 by the hydraulic actuators 840. This, in turn, causes the necking die 886 to move toward the open end of the container body 986 such that an inner forming surface of the necking die 886 comes into contact with the outer surface of the container body 986. Air under pressure may then be introduced into the interior of the container body 986 through the channel 788 extending through the shaft 786 in order to pressurize the container body 986 to maintain its structural integrity in the axial directions during the die-necking operation. Concurrently, sufficient linear force is applied to the necking die 886, via the lower drive plate 800 to cause the open end of the container body 986 to conform to the shape of the inner forming surface of the necking die 886, and thus, reduce the diameter of the open end.

As noted previously, the knockout elements (e.g., the knockout element 788 in the station 386) provide support during the necking process to the inside diameter of the open end of the container bodies being die-necked. If desired, the system can be configured so that the knockout elements are in motion (e.g., retracting from the open end of the container bodies) while the die-necking operation is taking place in order to assist in drawing the metal in a longitudinal direction and to prevent pleating of the metal containers in their neck portions.

After the necking dies have reached their maximum extension relative to the container bodies, the die-necking stage is completed. Thereafter, the lower drive plate 800 is caused to move in the direction 302 (FIG. 3) by the hydraulic actuators 840. This, in turn, causes the necking die 886 to move away from the open end of the container body 986. The upper drive plate 700 is also caused to move in the direction 302 by the hydraulic actuators 740, causing the knockout element 788 to withdraw from the container body 986. Both the knockout element 788 and the air pressure inside the container body 986 helps to separate the container body from the necking die 886. Thereafter, the conveyor 900 indexes, causing each of the container bodies to advance one position to the next workstation. This cycle is then repeated throughout the manufacturing process.

The modular unit 300 described herein offers many advantages over other types of equipment sometimes used for similar purposes. The modular unit 300, for example, provides excellent control of the die-necking process because the container bodies are accurately located within each station. As discussed previously, open ended container bodies are supported on the upper surface of the guide plate 470 while being conveyed through the modular unit 300. Because the guide plate 470 extends throughout all of the workstations, the bottom elevation of the containers (sometimes referred to in the industry as the "tin line") can be maintained throughout each of the workstations in a highly consistent manner. Further, the use of vacuum (via the vacuum holes 480) in each workstation ensures that the container bodies are stabilized and securely held in place against the upper surface of the guide plate 470. The design of the modular unit 300 also allows the guide posts 310 to accurately maintain alignment and parallelism between the stationary base plate 400, the stationary support plate 600, the upper drive plate 700 and the lower drive plate 800.

Also, as previously discussed, downward travel of the lower drive plate 800 is limited by a plurality of hard stop pins 850. This ensures that the extent of downward movement of the necking dies can be precisely set and maintained. Further, the hard stop pins 850 can readily be adjusted, or changed out, in order to change the necking depth achieved by the necking dies attached to the lower drive plate 800.

The design of the modular unit 300 is also advantageous in that it allows for independent control of the upper drive plate 700 and lower drive plate 800. Thus, parameters such as the stroke length, speed and timing of one drive plate can be set or adjusted independently of the other drive plate.

With reference, for example, to FIG. 3, it is noted that the guide posts 310 are illustrated generally as being just long enough to accommodate the movement range of the upper and lower drive plates 700, 800. Alternatively however, the guide posts 310 may be made longer than the necessary movement range in order to allow for increases in the stroke lengths of the upper drive plate 700, the lower drive plate 800, or both. In this manner, the flexibility of the modular unit 300 may be further enhanced to allow for future variations in stroke length and there are virtually no limitations on the stroke lengths that may be achieved.

The modular unit 300 is also easily adaptable to accommodate different container body diameters, simply by moving the transport system 900 and guide rail assembly 906, FIGS. 3-5.

It is noted that the modular unit 300 has generally been described having die-necking tooling located at each station for exemplary purposes only. The modular unit 300 could, alternatively, be used for processes other than die-necking. As a further alternative, the modular unit 300 could include die-necking tooling at some of its stations and different types of tooling or devices (e.g., for trimming, flanging, lubricating, profiling or bottom-forming operations) at other stations.

As can be appreciated from the above, the modular unit 300 can be used to progressively die-neck open ended containers in a series of up to ten die-necking stations. If more stations are required, multiple modular units, such as the modular unit 300 described above, may be combined, into a manufacturing system comprising any number of manufacturing units. FIGS. 1 and 2, as previously discussed, illustrate a manufacturing system 50 comprising the three modular units 100, 200 and 300. The modules 100 and 200 may, for example, be configured in substantially the same manner as described above with respect to the modular unit 300. Further, although three modular units are shown in FIGS. 1 and 2, it should be understood that any number of modular units may be assembled, as needed to provide the desired number of stations.

Figure 9:
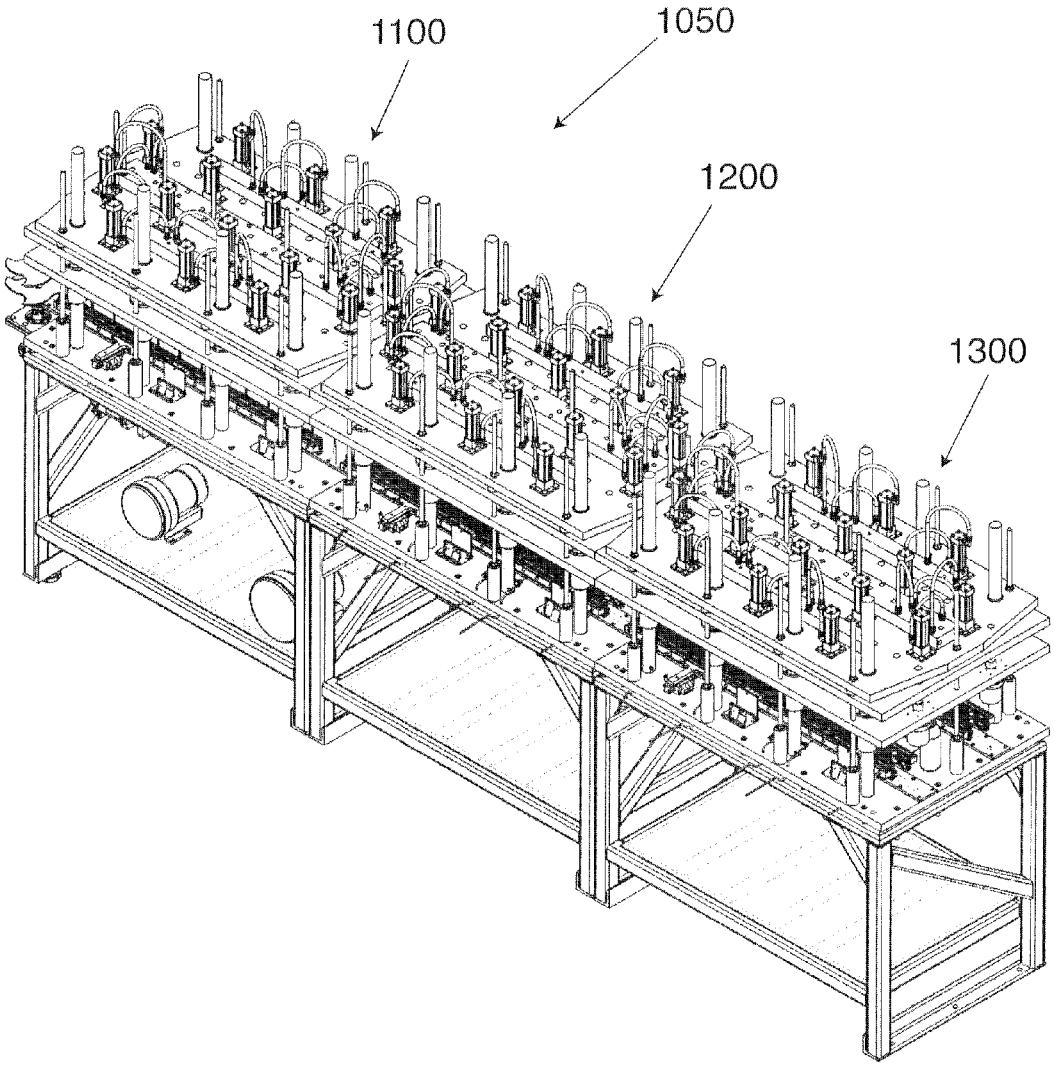
FIG. 9 is front perspective view of an alternate exemplary embodiment of a manufacturing system.

FIG. 9 shows an exemplary embodiment of an alternative manufacturing system 1050 which may be used, for example, to progressively die-neck open ended containers in a series of die-necking stations. With reference to FIG. 9, the manufacturing system 1050 may include a plurality of modular units, such as the modular units 1100, 1200, and 1300.

FIGS. 10-19 illustrate the modular unit 1300 in further detail. In general terms, the modular unit 1300 may include a stationary base plate 1400 and a stationary support plate 1600 arranged in a substantially parallel manner with respect to the stationary base plate 1400. The stationary base plate 1400 may, for example, be rigidly secured to machine support framework 1350 which, in turn, may be secured to the floor of a manufacturing facility (not shown) in a conventional manner. A pair of movable drive plates, movable upper drive plate 1700 and movable lower drive plate 1800 may be positioned between the stationary plates 1400 and 1600.

Figure 10:
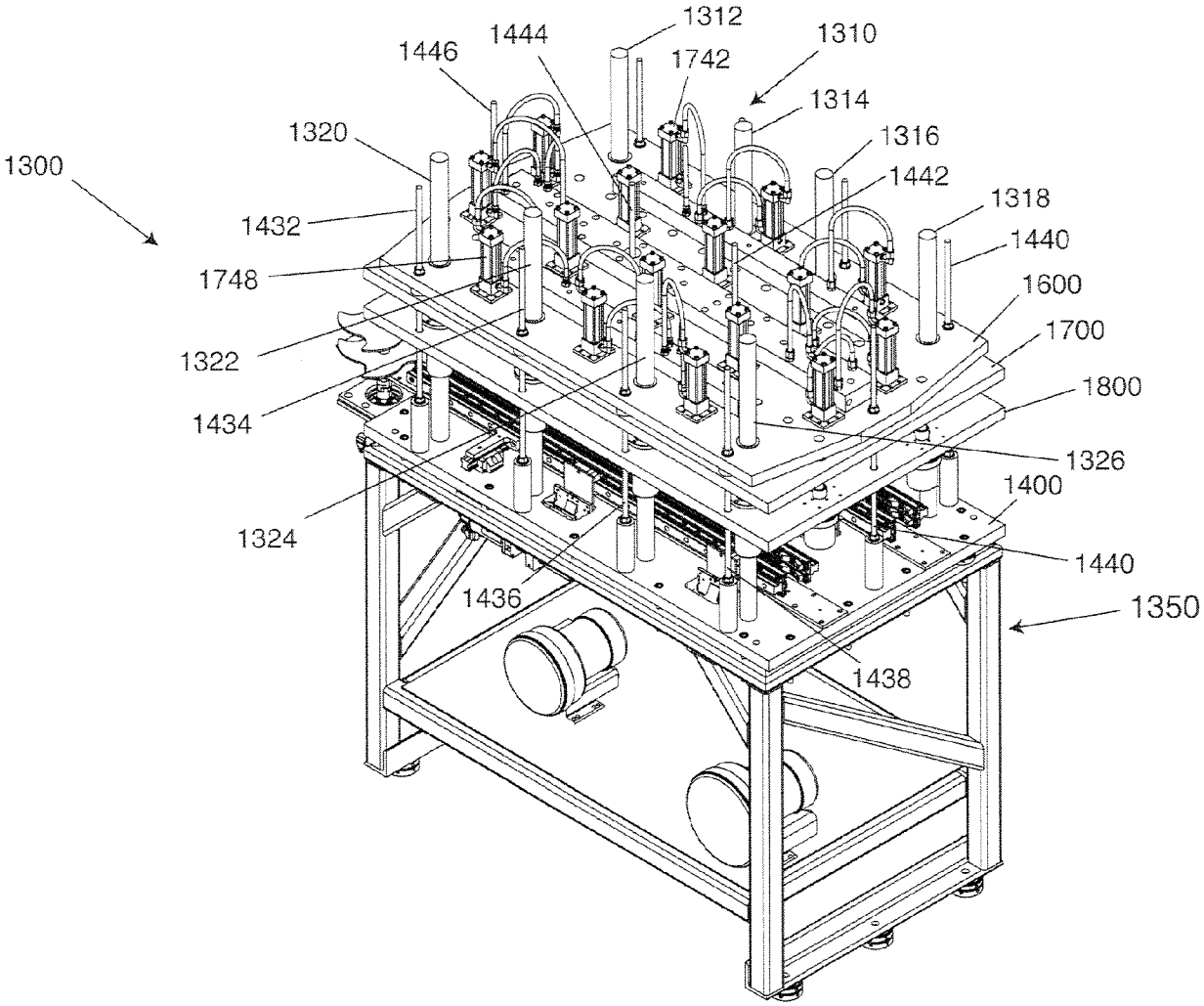
FIG. 10 is a front perspective view of an exemplary modular unit of the manufacturing system of FIG. 9.

With reference, for example, to FIG. 10, a plurality of guide posts 1310, including the individual guide posts 1312, 1314, 1316, 1318, 1320, 1322, 1324, and 1326 may be secured at their lower ends to the base plate 1400. The guide posts 1310 may each extend through a corresponding opening in the stationary support plate 1600 as shown, for example, in FIG. 10.

Figure 12:
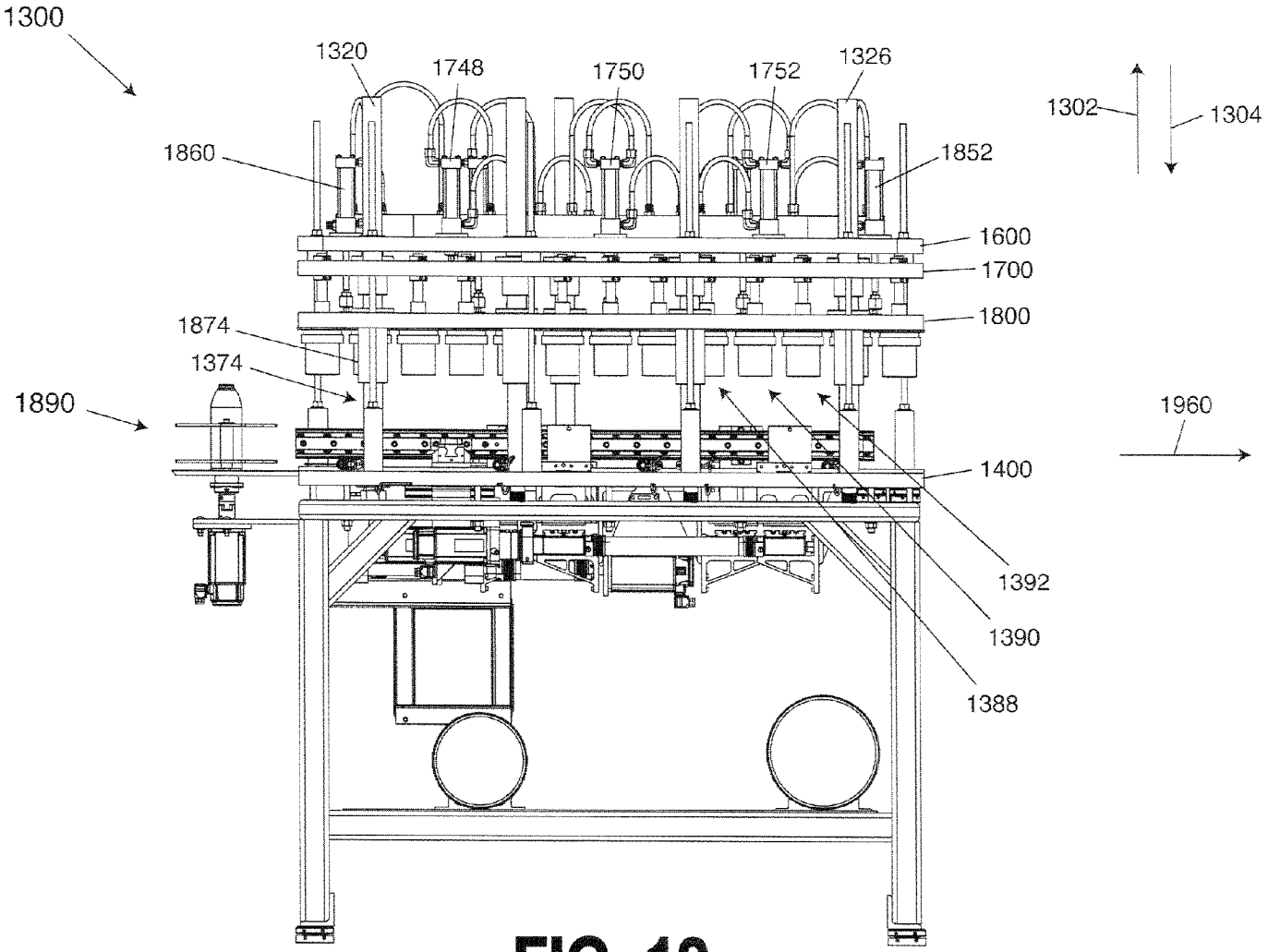
FIG. 12 is a front elevation view of the exemplary modular unit of FIG. 10.
Figure 13:
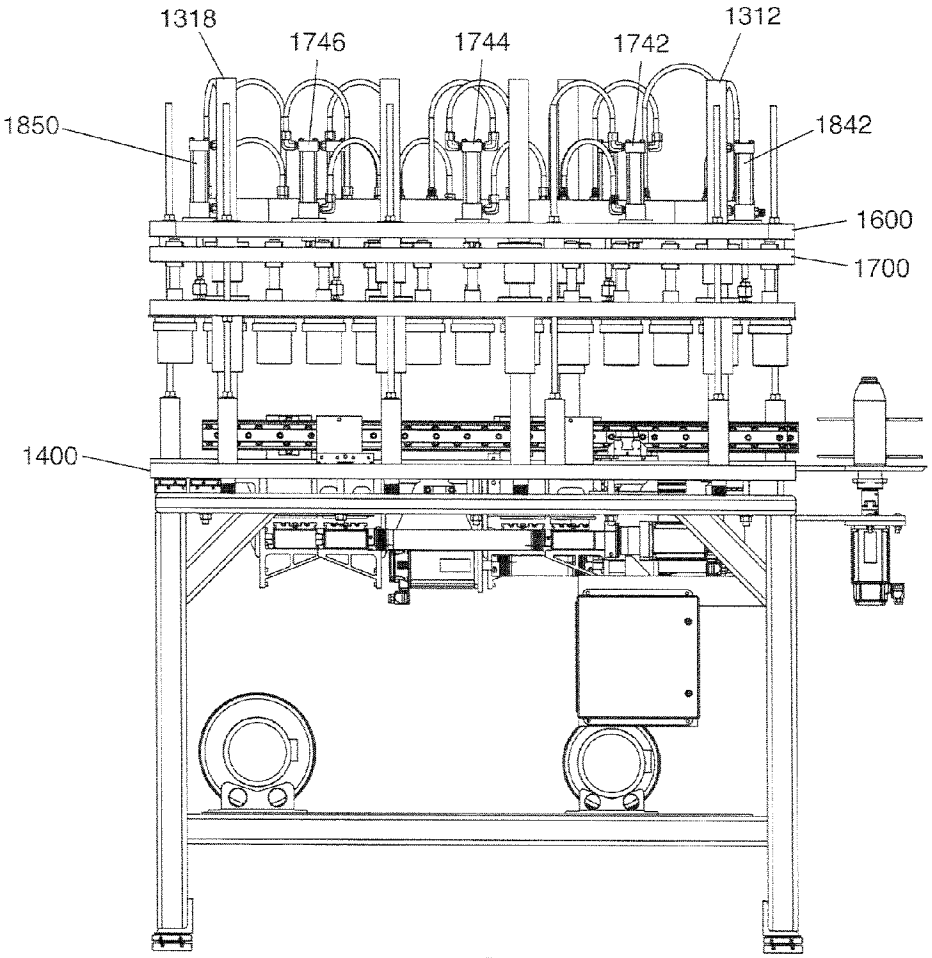
FIG. 13 is a rear elevation view of the exemplary modular unit of FIG. 10.
Figure 14:
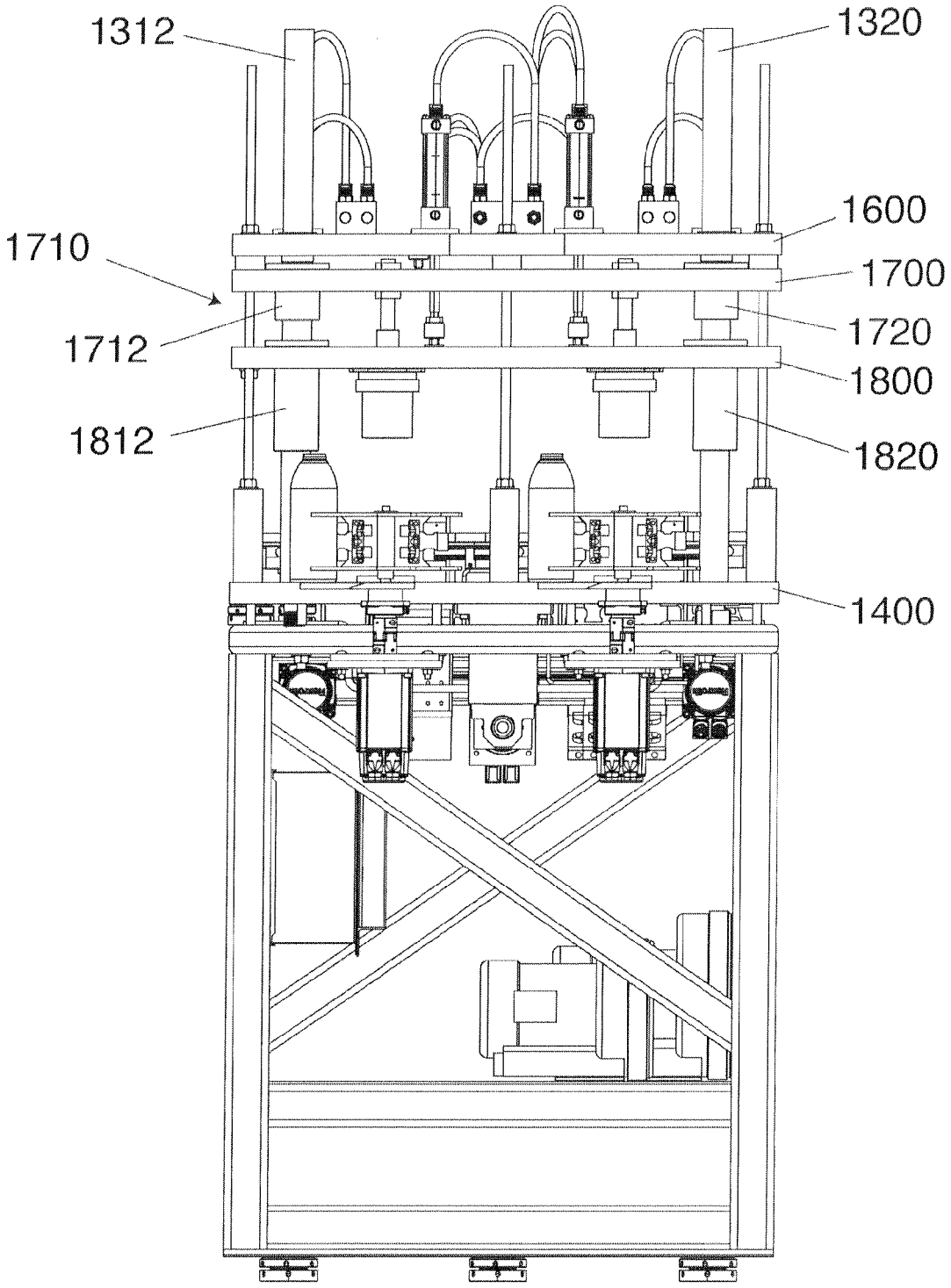
FIG. 14 is a left side elevation view of the exemplary modular unit of FIG. 10.
Figure 15:
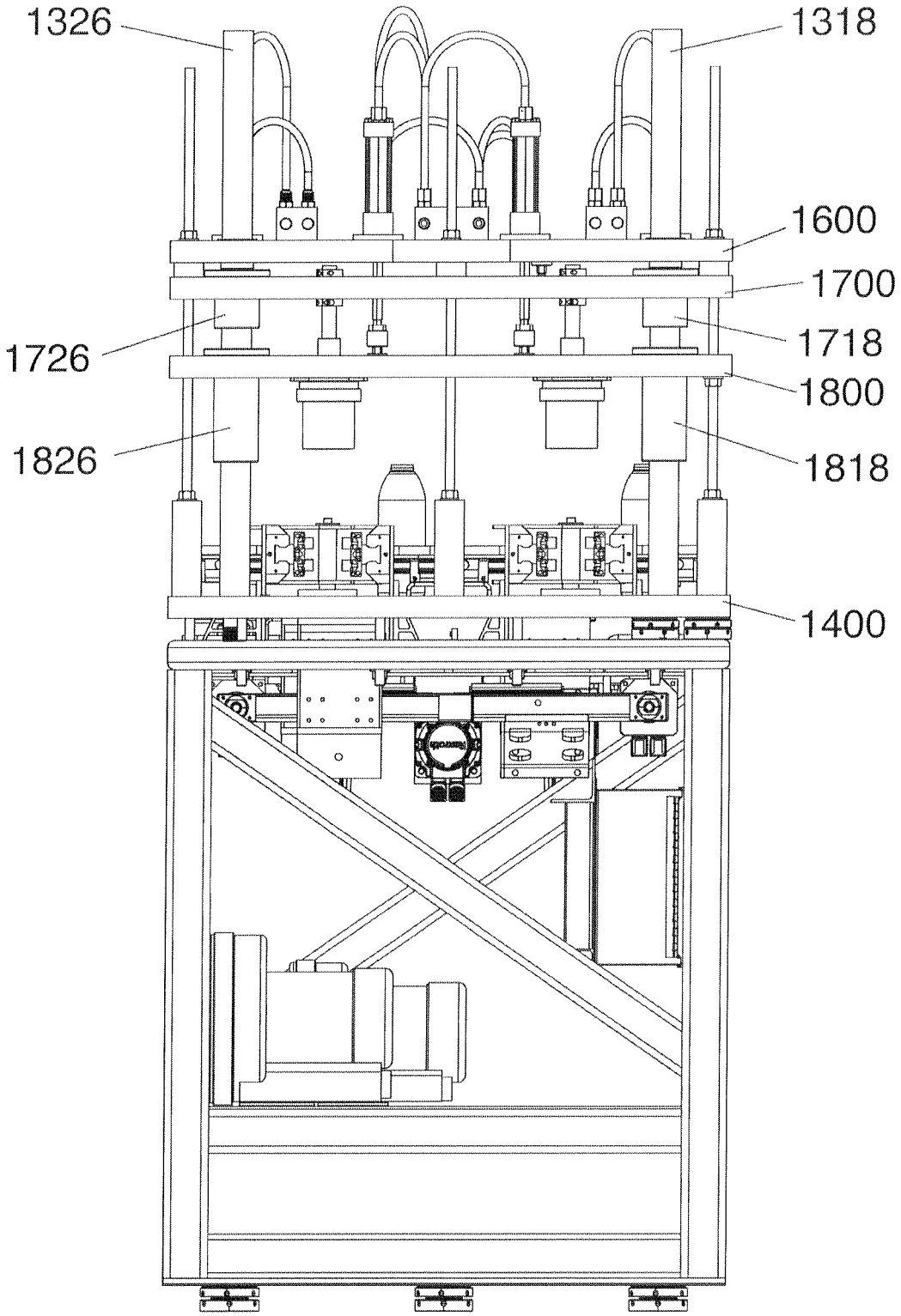
FIG. 15 is a right side elevation view of the exemplary modular unit of FIG. 10.

With reference, for example, to FIGS. 10-15 and 17, the modular unit 1300 may further include a movable upper drive plate 1700 located below the stationary support plate 1600, as shown. Upper drive plate 1700 may be slidingly mounted on the guide posts 1310 via a plurality of bearings 1710, one of which may be mounted on each of the guide posts 1310. With reference to FIGS. 14 and 15, it can be seen that the bearings 1710 may include, for example, the individual bearings 1712, 1718, 1720, and 1726 mounted on the guide posts 1312, 1318, 1320, and 1326, respectively. The bearings 1710 may, for example, be linear ball bearing assemblies.

Figure 16:
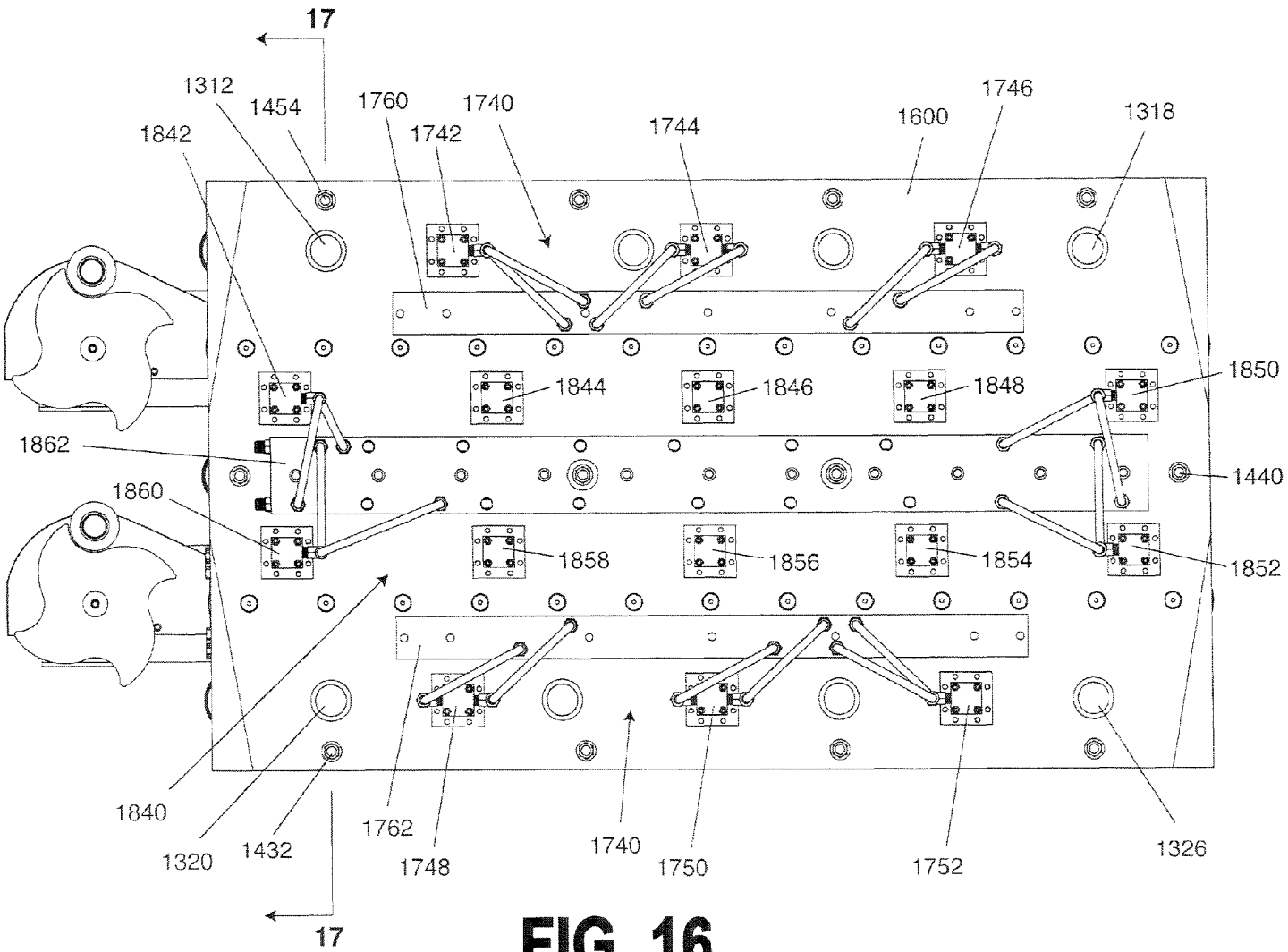
FIG. 16 is a top plan view of the exemplary modular unit of FIG. 10.

With reference, for example, to FIGS. 12, 13, and 16, a plurality of hydraulic actuators 1740, including the individual actuators 1742, 1744, 1746, 1748, 1750 and 1752 may be attached between the upper drive plate 1700 and the stationary support plate 1600, as shown. As shown in FIG. 16, the actuators 1742, 1744, and 1746 may be hydraulically connected to a first manifold block 1760 and the actuators 1744, 1746, and 1748 may be hydraulically connected to a second manifold block 1762. The manifold blocks 1760 and 1762, in turn, may be connected to a first control valve of a hydraulic pump system, not shown, in a conventional manner such that selective actuation of the first control valve will cause the upper drive plate 1700 to move in the directions 1302 or 1304, FIG. 12.

With reference again to FIGS. 10-15 and 17, the modular unit 1300 may further include a movable lower drive plate 1800 located below the stationary support plate 1600 and the upper drive plate 1700 and above the stationary base plate 1400. Lower drive plate 1800 may be slidingly mounted on the guide posts 1310 via a plurality of bearings 1810, one of which may be mounted on each of the guide posts 1310. With reference to FIGS. 14 and 15, it can be seen that the bearings 1810 may include, for example, the individual bearings 1812, 1818, 1820, and 1826 mounted on the guide posts 1312, 1318, 1320, and 1326, respectively. The bearings 1810 may, for example, be linear ball bearing assemblies.

With reference to FIGS. 12, 13, and 16, a plurality of hydraulic actuators 1840, including the individual actuators 1842, 1844, 1846, 1848, 1850, 1852, 1854, 1856, 1858, and 1860 may be attached between the lower drive plate 1800 and the stationary support plate 1600, as shown. As shown in FIG. 16, the actuators 1840 may be hydraulically connected to a manifold block 1862. The manifold block 1862, in turn, may be connected to a second control valve of the hydraulic pump system, not shown, in a conventional manner such that selective actuation of the second control valve will cause the lower drive plate 1800 to move in the directions 1302 or 1304, FIG. 12.

It is noted that the upper drive plate 1700 and the lower drive plate 1800 have been described above as being movable by hydraulic actuators. It is to be understood, however, that this description is provided for exemplary purposes only and that other types of actuators (e.g., pneumatic cylinders, linear motors, screw-drive arrangements) could readily be used in place of the hydraulic actuators described.

Figure 11:
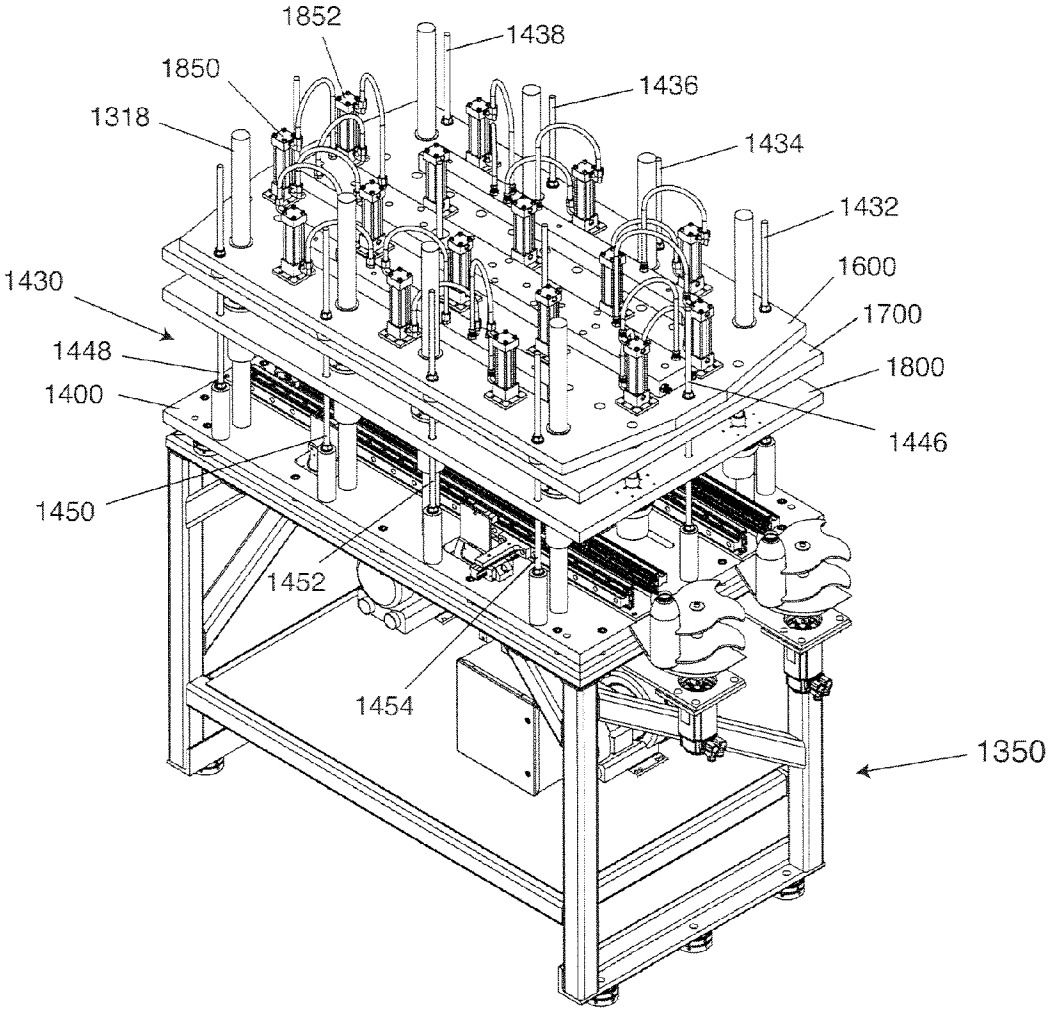
FIG. 11 is a rear perspective view of the exemplary modular unit of FIG. 10.

With reference to FIGS. 10 and 11, a plurality of threaded tension rods 1430 including, for example, the individual rods 1432, 1434, 1436, 1438, 1440, 1442, 1444, and 1446, 1448, 1450, 1452, and 1454 may extend upwardly from the stationary base plate 1400, as shown. The threaded tension rod 1440 will now be described in further detail, it being understood that the remaining rods 1430 may each be configured in a similar manner.

Figure 19:
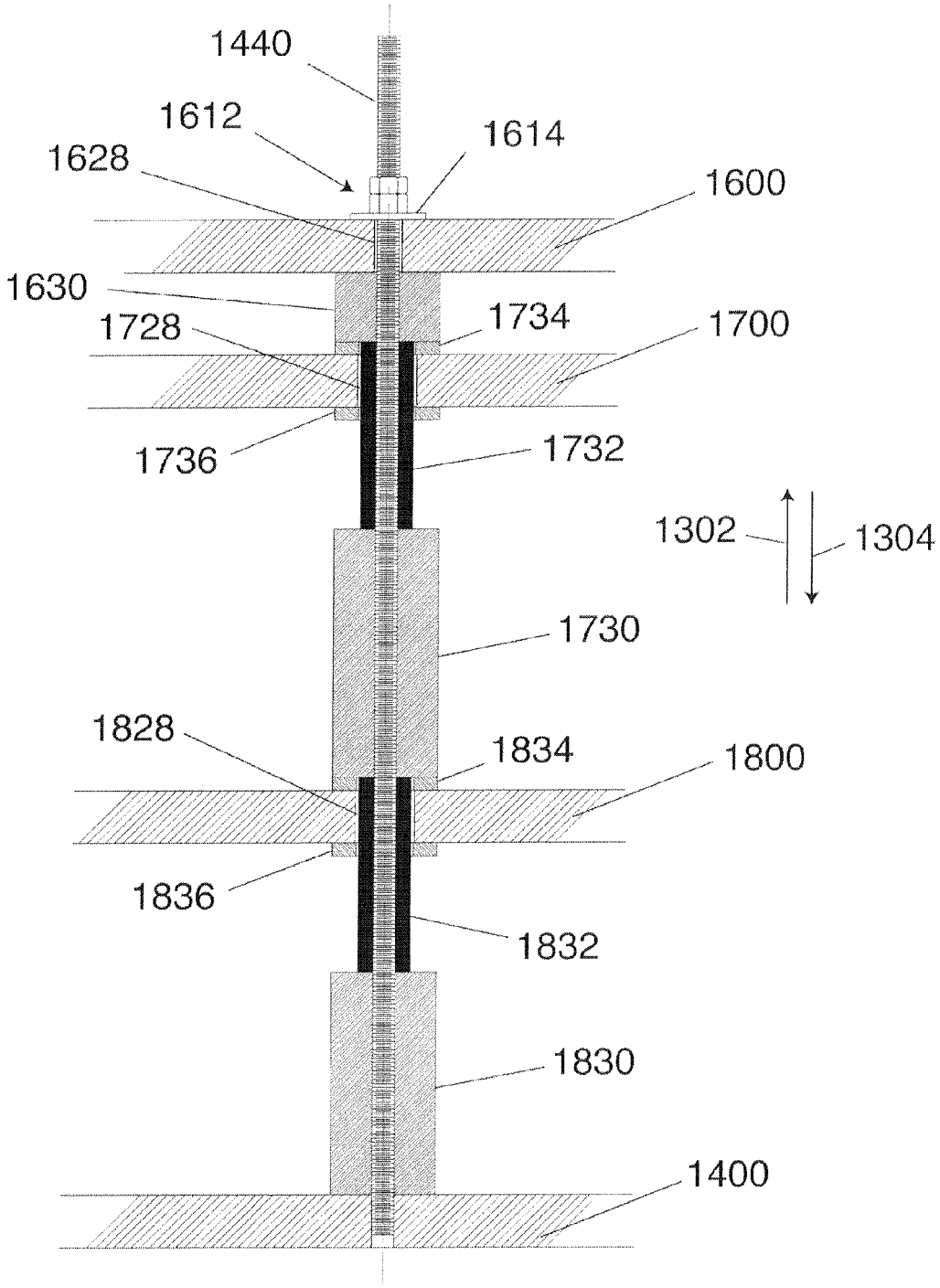
FIG. 19 is a schematic view showing one embodiment of a threaded rod and stop block arrangement that may be used in conjunction with the exemplary modular unit of FIG. 10.

FIG. 19 schematically illustrates one embodiment of a plurality of stop blocks that may be used to provide definite, mechanical movement limits to the downward travel of the upper drive plate 1700 and lower drive plate 1800. It is to be understood that, although FIG. 19 depicts the rod 1440, the remaining threaded rods 1430 may be configured in a substantially similar manner to the rod 1440. With reference now to FIG. 19, the rod 1440 may be threadedly attached within a corresponding threaded opening 1420 formed in the stationary base plate 1400. The rod 1440 may extend upwardly from the stationary base plate 1400 and through holes 1628, 1728, and 1828 formed in the stationary support plate 1600, the movable upper drive plate 1700, and the moveable lower drive plate 1800, respectively.

With further reference to FIG. 19, a cylindrical lower drive plate stop block 1830 may be located between the stationary base plate 1400 and the lower drive plate 1800, as shown. In a similar manner, a cylindrical upper drive plate stop block 1730 may be located between the upper drive plate 1700 and the lower drive plate 1800 and a spacer block 1630 may be located between the stationary plate 1600 and the upper drive plate 1700. A first spacer member 1832 may be located between the upper drive plate stop block 1730 and the lower drive plate stop block 1830 and a second spacer member 1732 may be located between the spacer block 1630 and the upper drive plate stop block 1730. Each of the lower drive plate stop block 1830, the upper drive plate stop block 1730, the first spacer 1832, the second spacer 1732, and the spacer block 1630 may include a non-threaded hole therethrough to accommodate the rod 1440, as shown in FIG. 19.

A first pair of hardened strike plates 1734, 1736 may be attached to opposite faces of the upper drive plate 1700 adjacent the opening 1728, as shown. A second pair of hardened strike plates 1834, 1836 may be attached to opposite faces of the lower drive plate 1800 adjacent the opening 1828. The hardened strike plates 1734, 1736, 1834, and 1836 may be attached to the respective drive plates using screws (not shown) or alternatively in any conventional manner.

With continued reference to FIG. 19, a pair of lock nuts 1612 and a washer 1614 may be provided on the threaded rod 1440 above the stationary support plate 1600, as shown. As can be appreciated, tightening the nuts 1612 against the washer 1614 and stationary support plate 1600 will serve to tension the threaded rod 1440 and lock the stationary support plate 1600 in place. As can further be appreciated, the arrangement described above allows the height of the stationary support plate 1600 (i.e., its distance from the stationary base plate 1400) to be varied and set by selecting a different aggregate height of the various spacers (e.g., the spacer block 1630, the second spacer member 1732, and the first spacer member 1832, shown in FIG. 19).

In operation, the lower drive plate stop blocks (e.g., the lower drive plate stop block 1830 shown in FIG. 19) serve to provide a definite limit of downward travel for the lower drive plate 1800. Specifically, as the lower drive plate 1800 is urged downwardly (i.e., in the direction 1304) by the hydraulic actuators 1840, the hardened strike plates on the lower surface of the drive plate 1800 (e.g., the hardened strike plate 1836 shown in FIG. 19) will approach the lower drive plate stop blocks (e.g., the lower drive plate stop bock 1830 shown in FIG. 19). When the hardened strike plates make contact with the lower drive plate stop blocks, further downward movement of the lower drive plate 1800 is mechanically prevented. Thus, the lower drive plate stop blocks provide a definite, mechanical limit to the downward travel of the lower drive plate 1800. Further this limit can readily be changed or adjusted to any desired position simply by replacing the lower drive plate stop blocks with stop blocks having a different height.

In a similar manner, the upper drive plate stop blocks (e.g., the upper drive plate stop block 1730 shown in FIG. 19) serve to provide a definite limit of downward travel for the upper drive plate 1700. Specifically, as the upper drive plate 1700 is urged downwardly (i.e., in the direction 1304) by the hydraulic actuators 1740, the hardened strike plates on the lower surface of the drive plate 1700 (e.g., the hardened strike plate 1736 shown in FIG. 19) will approach the upper drive plate stop blocks (e.g., the upper drive plate stop bock 1730 shown in FIG. 19). When the hardened strike plates make contact with the upper drive plate stop blocks, further downward movement of the upper drive plate 1700 is mechanically prevented. Thus, the upper drive plate stop blocks provide a definite, mechanical limit to the downward travel of the upper drive plate 1700. Further this limit can readily be changed or adjusted to any desired position simply by replacing the upper drive plate stop blocks with stop blocks having a different height.

Figure 18:
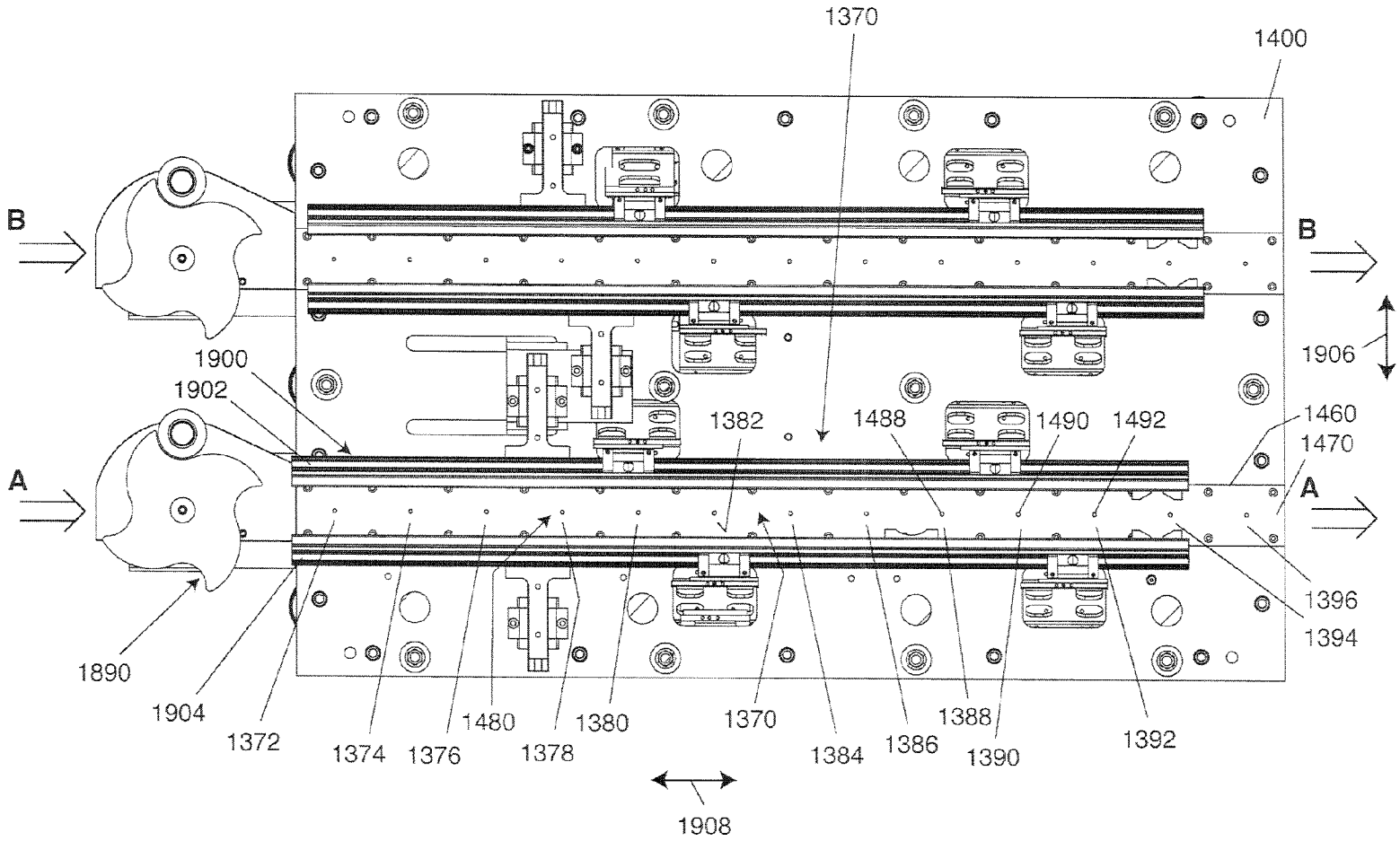
FIG. 18 is a top plan view of the exemplary modular unit of FIG. 10, with an upper portion of the apparatus removed for illustrative clarity.

FIG. 18 illustrates a top plan view of the modular unit 1300, with the stationary support plate 1600, upper drive plate 1700, lower drive plate 1800, and related apparatus removed for purposes of illustrative clarity. With reference to FIG. 18, a pair of parallel movement paths may be defined through the modular unit 1300, as indicated by the arrows "A" and "B" in the drawing. Within each movement path, a conveyor, as will be described in further detail herein, may be used to advance open ended container bodies through a series of progressive workstations within the modular unit. Since the movement paths "A" and "B" may be substantially identical to one another, only the path "A" will be described in further detail herein.

With reference again to FIG. 18, the modular unit 300 may include a plurality of workstations 1370 within the movement path "A", such as the individual workstations 1372, 1374, 1376, 1378, 1380, 1382, 1384, 1386, 1388, 1390, 1392, 1394, and 1396. The workstations may be used, for example, to die-neck open ended container bodies, with each workstation containing a progressively smaller necking die, in a manner such as previously described.

With reference again to FIG. 18, a guide plate 1470 may be positioned above the stationary base plate 1400 for the purpose of supporting container bodies as they advance through the modular unit 1300, in a manner described in further detail below. The guide plate 1470 may include a plurality of holes 1480, one located within each of the workstations 1370. The plurality of holes 1480 may include, for example, the individual holes 1488, 1490, and 1492 located within the workstations 1388, 1390, and 1392, respectively. Each of the holes 1480 may be generally circular in cross section and may be connected to a vacuum source in order to supply vacuum to the upper surface of the guide plate 1460 at the locations of the holes 1480 within each of the workstations 1370. As will be described in further detail herein, the vacuum supplied by the holes 1480 serves to hold the container bodies securely against the guide plate 1460 while the cans are being die-necked within each of the workstations 1370.

Figure 17:
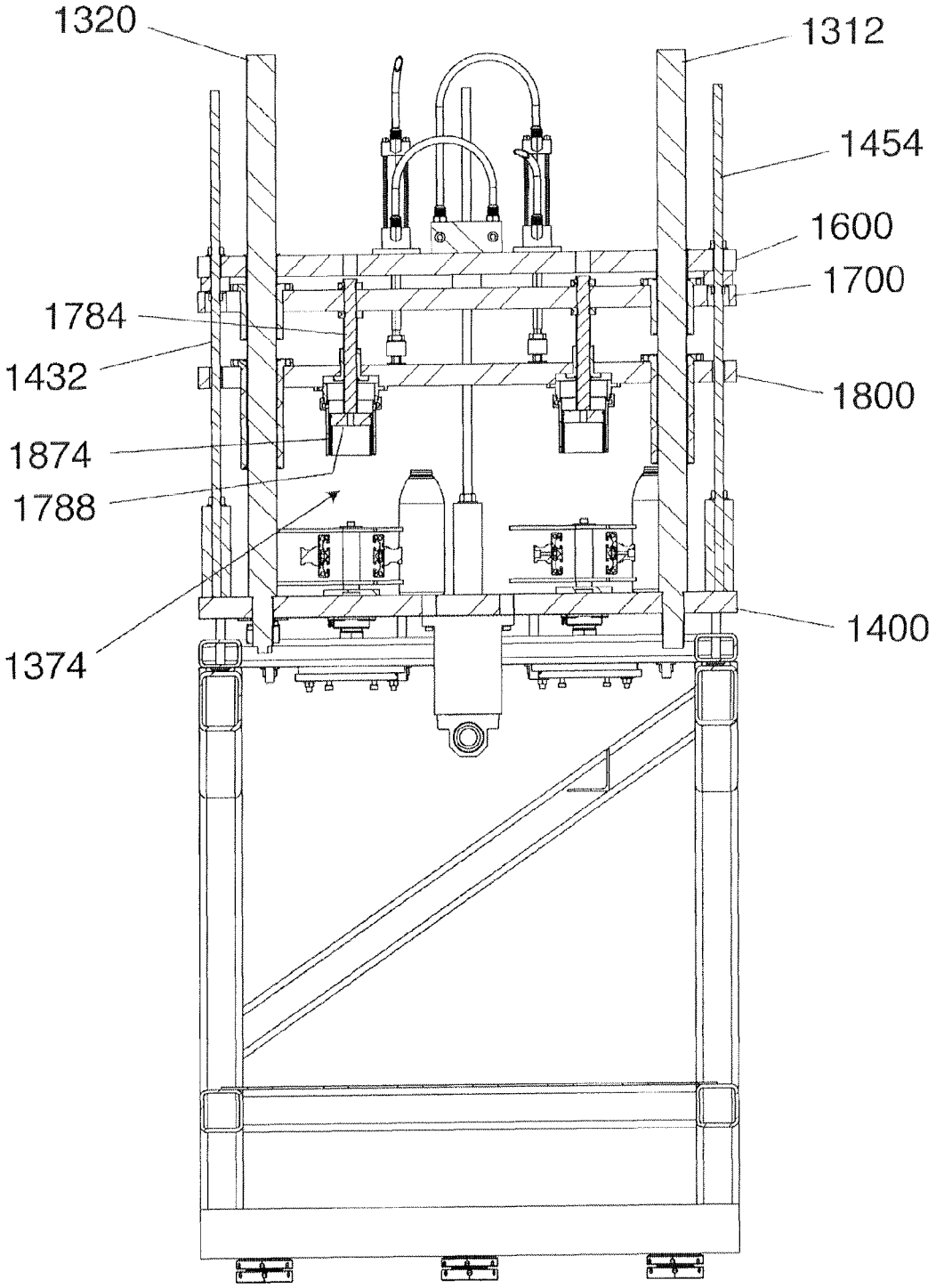
FIG. 17 is a cross-sectional elevation view of the exemplary modular unit of FIG. 10, taken along the line 17-17 of FIG. 16.

The lower drive plate 1800 may include a plurality of necking dies fixedly attached thereto, one necking die located within each of the workstations 1370. With reference to FIGS. 12 and 17 it can be seen, for example, that the lower drive plate 1800 includes a necking die 1874 within the workstation 1374. As can be appreciated, movement of the lower drive plate 1800 will result in corresponding movement of the attached necking dies.

The upper drive plate 1700 may include a plurality of shafts fixedly attached thereto, one shaft located within each of the workstations 1370. Each of these shafts has a knockout element attached at the lower end thereof. With reference to FIG. 17, it can be seen, for example, that the shaft 1784 is attached to the upper drive plate 1700 in the area of the workstation 1374. A knockout element 1788 is attached at the lower end of the shaft 1784. As can be appreciated, movement of the upper drive plate 1700 will result in corresponding movement of the attached knockout elements. Further, each of the upper drive plate shafts may also include a channel extending therethrough for the purpose of supplying pressurized air to a container body being die-necked.

With reference to FIGS. 12 and 18, the modular unit 1300 may generally include a transport system 1890 for moving open ended container bodies (in the direction 1960, FIG. 12) in a stepwise, or indexing, fashion such that the open ended container bodies advance from workstation to workstation within movement path "A" of the modular unit 1300 and dwell within each workstation while the die-necking operation is carried out. The transport system 1890 may take the form of any conventional type of movement device, for example, a screw conveyor, a belt-type conveyor or a pick and place mechanism.

In a preferred embodiment, the transport system 1890 may, for example, be provided as a pick and place conveyor 1900, sometimes referred to in the industry as a "walking beam conveyor". With reference to FIG. 18, the conveyor 1900 may include a pair of beams 1902, 1904 that are each capable of movement in the both the directions 1906, 1908 in order to sequentially grasp, advance and release open ended container bodies (e.g., the container bodies 986, 988, 990) within the modular unit 1300. The conveyor 1900 advances the container bodies in a stepwise, or indexing, fashion such that the open ended container bodies advance from station to station within the modular unit 1300 and dwell within each station while the die-necking operation is carried out.

The die-necking operation takes place in each workstation of movement path "A" of the modular unit in a manner similar to that previously described with respect to FIG. 8. Within each of the workstations 1370 (FIG. 18), for example, the conveyor 1900 first indexes a container body into place within the workstation. Vacuum supplied to the vacuum holes 1480, including, for example, the vacuum holes 1488, 1490, and 1492 located within the workstations 1388, 1390, and 1392, respectively, ensures that the bottom of each container is securely held against the upper surface of the guide plate 1470. The upper drive plate 1700 is then caused to move in the direction 1304 (FIG. 12) by the hydraulic actuators 1740. This, in turn, causes one of the knockout elements (e.g., the knockout element 1788, FIG. 17) to extend into each container body so that the knockout element becomes inserted inside the open end of the container body. Once the knockout elements are in place, the lower drive plate 1800 is caused to move in the direction 1304 by the hydraulic actuators 1840. This, in turn, causes one of the necking dies (e.g., the necking die 1874, FIG. 17) to move toward the open end of each container body such that inner forming surfaces of the necking dies come into contact with the outer surface of each container body. Air under pressure may then be introduced into the interior of each container body through the channels extending through the upper drive plate shafts in order to pressurize the container bodies to maintain their structural integrity in the axial directions during the die-necking operation. Concurrently, sufficient linear force is applied to the necking dies, via the lower drive plate 1800, to cause the open end of each container body to conform to the shape of the inner forming surface of each necking die, and thus, reduce the diameter of the open end.

As noted previously, the knockout elements (e.g., the knockout element 1788, FIG. 17) provide support during the necking process to the inside diameter of the open end of the container bodies being die-necked. If desired, the system can be configured so that the knockout elements are in motion (e.g., retracting from the open end of the container bodies) while the die-necking operation is taking place in order to assist in drawing the metal in a longitudinal direction and to prevent pleating of the metal containers in their neck portions.

After the necking dies have reached their maximum extension relative to the container bodies, the die-necking stage is completed. Thereafter, the lower drive plate 1800 is caused to move in the direction 1302 (FIG. 12) by the hydraulic actuators 1840. This, in turn, causes the necking dies (e.g., the necking die 1874, FIG. 17) to move away from the open ends of the container bodies. The upper drive plate 1700 is also caused to move in the direction 1302 by the hydraulic actuators 1740, causing the knockout elements (e.g., the knockout element 1788, FIG. 17) to withdraw from the container bodies. Both the knockout elements and the air pressure inside the container bodies help to separate the container bodies from the necking dies. Thereafter, the conveyor 1900 indexes, causing each of the container bodies to advance one position to the next workstation. This cycle is then repeated throughout the manufacturing process.

The modular unit 1300 described herein offers many advantages over other types of equipment sometimes used for similar purposes. The modular unit 1300, for example, provides excellent control of the die-necking process because the container bodies are accurately located within each station. As discussed previously, open ended container bodies are supported on the upper surface of the guide plate 1470 while being conveyed through the modular unit 1300. Because the guide plate 1470 extends throughout all of the workstations, the bottom elevation of the containers (sometimes referred to in the industry as the "tin line") can be maintained throughout each of the workstations in a highly consistent manner. Further, the use of vacuum (via the vacuum holes 1480) in each workstation ensures that the container bodies are stabilized and securely held in place against the upper surface of the guide plate 1470. The design of the modular unit 1300 also allows the guide posts 1310 to accurately maintain alignment and parallelism between the stationary base plate 1400, the stationary support plate 1600, the upper drive plate 1700, and the lower drive plate 1800.

Also, as previously discussed, downward travel of the lower drive plate 1800 is limited by a plurality of stop blocks (e.g., the stop block 1830, FIG. 19). This ensures that the extent of downward movement of the necking dies can be precisely set and maintained. Further, the stop blocks can readily be adjusted, or changed out, in order to change the necking depth achieved by the necking dies attached to the lower drive plate 1800.

The design of the modular unit 300 is also advantageous in that it allows for independent control of the upper drive plate 700 and lower drive plate 1800. Thus, parameters such as the stroke length, speed and timing of one drive plate can be set or adjusted independently of the other drive plate.

It is noted that the modular unit 1300 has generally been described having die-necking tooling located at each station for exemplary purposes only. The modular unit 1300 could, alternatively, be used for processes other than die-necking. As a further alternative, the modular unit 300 could include die-necking tooling at some of its stations and different types of tooling or devices (e.g., for trimming, flanging, lubricating, profiling or bottom-forming operations) at other stations.

As can be appreciated from the above, the modular unit 1300 can be used to progressively die-neck open ended containers in a series of up to thirteen die-necking stations. If more stations are required, multiple modular units, such as the modular unit 1300 described above, may be combined, into a manufacturing system comprising any number of manufacturing units. FIG. 9, as previously discussed, illustrates a manufacturing system 1050 comprising the three modular units 1100, 1200 and 1300. The modules 1100 and 1200 may, for example, be configured in substantially the same manner as described above with respect to the modular unit 1300. Further, although three modular units are shown in FIG. 9, it should be understood that any number of modular units may be assembled, as needed to provide the desired number of stations.

The foregoing description of specific embodiments of the present invention has been presented for purposes of illustration and description. They are not intended to be exhaustive or to limit the invention to the precise forms disclosed, and many modifications and variations are possible in light of the above teaching. The embodiments described herein were chosen in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. Apparatus for forming open ends of open ended container bodies, said apparatus comprising:

a plurality of stations, each station being adapted to receive and temporarily retain an open ended container body therein with an open end of the container body exposed to allow forming thereof and with a closed end of said open ended container body continuously supported at a constant elevation during forming of said open end by a support plate surface positioned at an elevation that is the same in each of said plurality of work stations;

a conveyor adapted to move a plurality of said container bodies along a path in the apparatus, said conveyor adapted and controlled to advance said container bodies from station to station in steps of advancement with pauses therebetween; and wherein said path is linear.

2. Apparatus as in claim 1 and further wherein:

each of said plurality of stations comprises tooling for progressively die necking open ends of said container bodies.

3. Apparatus as in claim 1 and further wherein:

said plurality of stations are separated from one another by substantially equal spacings.

4. Apparatus as in claim 1 and further wherein:

each of said steps of advancement maintains said closed end of said container body at a constant elevation and produces an advancement that is the same for each step.

5. A method of forming open ends of container bodies within an apparatus comprising a plurality of stations, each of said plurality of stations being adapted to receive and temporarily retain therein a container body having an open end with the open end of the container body exposed to allow forming thereof, said method comprising:

locating a container body having an open end within a first station of said plurality of stations with a closed end of said container body continuously supported at a first elevation during the entire time said container body is in said first station including during forming of said open end;

moving said container body from said first station to a second station along a linear path; and locating said container body in a second station of said plurality of stations with a closed end of said container body continuously supported at said first elevation during the entire time said container body is in said second station including during forming of said open end.

6. The method of claim 5 and further wherein:

said moving said container body from said first station to said second station along a linear path is accomplished by a conveyor; and said conveyor is adapted and controlled to advance said container bodies from station to station in steps of advancement with pauses therebetween and with said closed ends of said container bodies maintained at a constant elevation through each of said steps of advancement.

7. The method of claim 5 and further wherein:

each of said plurality of stations comprises tooling for progressively die necking open ends of said container bodies.

8. The method of claim 5 and further wherein:

said plurality of stations are separated from one another by substantially equal spacings.

9. The method of claim 6 and further wherein:

each of said steps of advancement produces an advancement that is the same for each step.

10. The method of claim 5 and further comprising:

moving a knockout element at least partially into said container body through said open end thereof while said container body is located within said first station;

moving a forming die into forcible contact with said open end of said container body in order to form said open end of said container body while said container body is located within said first station;

maintaining said container body in a stationary configuration while said moving a knockout element and said moving a forming die are occurring within said first station.

11. The method of claim 10 and further comprising:

holding a closed end of said container body against a horizontally disposed support plate of said apparatus while said moving a knockout element and said moving a forming die are occurring within said first station.

12. The method of claim 11 and further comprising:

locating said container body within a second station of said plurality of stations; moving a knockout element at least partially into said container body through said open end thereof while said container body is located within said second station;

moving a forming die into forcible contact with said open end of said container body in order to form said open end of said container body while said container body is located within said second station; and holding said closed end of said container body against said horizontally disposed support plate while said moving a knockout element and said moving a forming die are occurring within said second station.

13. A method of forming open ends of container bodies within an apparatus comprising a plurality of forming stations, said method comprising:

locating a container body having an open end within a first station of said plurality of stations;

moving a knockout element at least partially into said container body through said open end thereof while said container body is located within said first station;

moving a forming die into forcible contact with said open end of said container body in order to form said open end of said container body while said container body is located within said first station;

maintaining said container body in a stationary configuration while said moving a knockout element and said moving a forming die are occurring within said first station;

holding a closed end of said container body at a first elevation against a horizontally disposed support plate of said apparatus while said moving a knockout element and said moving a forming die are occurring within said first station;

moving said closed end of said container body along a linear path across said horizontally disposed support plate to a second station of said plurality of work stations; and holding said closed end of said container body at said first elevation against said horizontally disposed support plate while moving a knockout element and moving a forming die are occurring within said second station.

14. The method of claim 13 and further comprising:

locating said container body within said second station of said plurality of stations;

moving a knockout element at least partially into said container body through said open end thereof while said container body is located within said second station;

moving a forming die into forcible contact with said open end of said container body in order to form said open end of said container body while said container body is located within said second station; and holding said closed end of said container body against said horizontally disposed support plate while said moving a knockout element and said moving a forming die are occurring within said second station.

15. The method of claim 13 and further wherein:

said holding a closed end of said container body against a support plate of said apparatus while said moving a knockout element and said moving a forming die are occurring within said first station comprises using vacuum to hold said closed end of said container body against said support plate.

16. The method of claim 13 and further wherein:

said plurality of forming stations are separated from one another by substantially equal spacings.

17. A method of forming open ends of container bodies within an apparatus comprising a plurality of forming stations, said method comprising:

locating a container body having an open end and a closed end within a first station of said plurality of stations with the closed end supported on a first horizontally disposed support plate;

moving a knockout element at least partially into said container body through said open end thereof while said container body is located within said first station and said closed end is supported on said first horizontally disposed support plate;

moving a forming die into forcible contact with said open end of said container body in order to form said open end of said container body while said container body is located within said first station and while said closed end is supported on said first horizontally disposed support plate;

maintaining said closed end of said container body in a stationary configuration at a constant elevation while said moving a knockout element and said moving a forming die are occurring within said first station;

moving said container body from said first station to a second station of said plurality of stations along a linear path with said closed end supported on said first horizontally disposed support plate;

locating said container body within said second station of said plurality of stations with said closed end supported on said first horizontally disposed support plate;

moving a knockout element at least partially into said container body through said open end thereof while said container body is located within said second station and said closed end is supported on said first horizontally disposed support plate; and moving a forming die into forcible contact with said open end of said container body in order to form said open end of said container body while said container body is located within said second station and said closed end is continuously supported on said first horizontally disposed support plate.

18. The method of claim 17 and further wherein:

said moving said container from said first station to said second station along said linear path is accomplished by a conveyor; and said conveyor is adapted and controlled to advance said container bodies from station to station in steps of advancement with pauses therebetween.

19. The method of claim 18 and further wherein:

each of said steps of advancement produces an advancement that is the same for each step.

* * * * *